US007244223B2

(12) United States Patent
Hartman et al.

(10) Patent No.: US 7,244,223 B2
(45) Date of Patent: Jul. 17, 2007

(54) FOOD BAG RELEASE VALVE

(75) Inventors: William G. Hartman, North Royalton, OH (US); Richard L. Sandt, Brunswick, OH (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 11/238,566

(22) Filed: Sep. 29, 2005

(65) Prior Publication Data

US 2006/0030472 A1 Feb. 9, 2006

(51) Int. Cl.
*B31B 1/84* (2006.01)

(52) U.S. Cl. ..... 493/213; 493/210; 383/103

(58) Field of Classification Search ..... 493/101, 493/210, 213; 383/100, 101, 102, 103; 53/410, 128.1, 133.1
See application file for complete search history.

(56) References Cited

U.S. PATENT DOCUMENTS

| | | | | | |
|---|---|---|---|---|---|
| 2,821,338 | A * | 1/1958 | Metzger | 383/103 |
| 2,927,722 | A * | 3/1960 | Metzger | 383/103 |
| 3,229,813 | A * | 1/1966 | Crowe, Jr. et al. | 383/103 |
| 3,432,087 | A * | 3/1969 | Costello | 383/103 |
| 3,468,471 | A * | 9/1969 | Linder | 383/102 |
| 3,503,497 | A * | 3/1970 | Adiletta et al. | 383/103 |
| 3,998,255 | A * | 12/1976 | Mather et al. | 383/102 |
| 4,000,846 | A | 1/1977 | Gilbert | 229/62.5 |
| 4,134,535 | A * | 1/1979 | Barthels et al. | 383/102 |
| 4,290,253 | A * | 9/1981 | Domke et al. | 53/410 |
| 4,310,118 | A * | 1/1982 | Kisida et al. | 383/102 |
| 4,640,838 | A * | 2/1987 | Isakson et al. | 383/103 |
| 5,263,777 | A * | 11/1993 | Domke | 383/103 |
| 5,277,741 | A * | 1/1994 | Kramer | 53/410 |
| 5,445,870 | A | 8/1995 | Buchner et al. | 428/214 |
| 5,727,881 | A * | 3/1998 | Domke | 383/103 |
| 5,989,608 | A | 11/1999 | Mizuno | 426/113 |
| 5,992,635 | A | 11/1999 | Walters | 206/524.8 |
| 6,358,731 | B1 * | 3/2002 | Hsu | 435/297.5 |
| 6,814,991 | B2 * | 11/2004 | Hiyoshi | 383/103 |
| 6,983,845 | B2 * | 1/2006 | Shah et al. | 383/103 |

(Continued)

FOREIGN PATENT DOCUMENTS

| | | |
|---|---|---|
| DE | 23 31 862 | 1/1975 |

(Continued)

OTHER PUBLICATIONS

PCT/US2004/017373; PCT International Search Report mailed Oct. 27, 2004.

(Continued)

*Primary Examiner*—Louis Huynh
(74) *Attorney, Agent, or Firm*—Renner, Otto, Boisselle & Sklar

(57) ABSTRACT

A method of making a plurality of flexible containers (12/112/212) comprising the steps of manufacturing a plurality of bag structures (13/113/213), separately manufacturing a plurality of valves (10/110/210), aligning the valves (10/110/210) with openings (24/124/224) in the bag structures (13/113/213), and securing the aligned valves (10/110/210) to the bag structures (13/113/213). Each valve (10/110/210) comprises a vent layer (30/130/230) which is pervious with respect to expected gasses and a sealed passageway is formed between the vent layer (30/130/230) and the container (12/112/212) when the valve (10/110/210) is secured to the bag structure (13/113/213).

15 Claims, 25 Drawing Sheets

U.S. PATENT DOCUMENTS

| | | | | |
|---|---|---|---|---|
| 2003/0035597 | A1 | 2/2003 | Buckingham et al. | 383/103 |
| 2004/0000501 | A1 | 1/2004 | Shah et al. | 206/524.8 |
| 2004/0000502 | A1 | 1/2004 | Shah et al. | 206/524.8 |
| 2004/0000503 | A1 | 1/2004 | Shah et al. | 206/524.8 |
| 2004/0223667 | A1* | 11/2004 | Shah et al. | 383/103 |

FOREIGN PATENT DOCUMENTS

| | | | |
|---|---|---|---|
| DE | 24 54 248 | | 5/1976 |
| DE | 33 12 887 | | 10/1984 |
| DE | 34 11 371 | | 10/1985 |
| DE | 35 21 373 | | 12/1986 |
| EP | 0043425 | * | 1/1982 |
| FR | 2 380 953 | | 9/1978 |
| GB | 1 583 503 | | 1/1981 |
| WO | 88/07479 | | 10/1988 |
| WO | 03/001096 | | 1/2003 |

OTHER PUBLICATIONS

PCT/US2004/017145; PCT International Search Report mailed Oct. 27, 2004.

PCT/US2004/017385; PCT International Search Report mailed May 17, 2005.

* cited by examiner

FOOD BAG RELEASE VALVE

RELATED APPLICATIONS

This application claims priority under 35 U.S.C. §120 to International Application No. PCT/US04/17373, International Application No. PCT/US04/17145, and International Application No. PCT/US04/17385, which each claimed priority to U.S. Provisional Patent Application Nos. 60/474,735 and 60/516,791. The entire disclosures of these international applications and these provisional applications are hereby incorporated by reference.

FIELD OF THE INVENTION

This invention relates generally, as indicated, to a food bag release valve and, more particularly, to a valve for selectively releasing unwanted gas from a food bag.

BACKGROUND OF THE INVENTION

Food bags are commonly used by consumers and industries to store food for later use or consumption. A standard food bag construction comprises a pair of rectangular side panels made from a thermoplastic material and joined together along side seams, a bottom seam, and a top seam. The side and bottom seams usually are permanent seals (e.g., heat sealed) and the top seam can be re-closeable.

Food bags are often used to store food for freezing whereby such bags are frequently referred to as freezer bags. A major complaint surrounding the use of freezer bags stems from what has come to be called "freezer burn;" that is, the dehydration that occurs when food is stored in the low humidity atmosphere of a freezer. Freezer burn can cause a complex deterioration of food quality involving undesirable texture changes, followed by chemical changes such as degradation of pigments and oxidative rancidity of lipids. Taste, aroma, mouth feel, and appearance all can be ruined.

The elimination of air from the interior cavity of the freezer bag is known to dramatically decrease freezer burn. To this end, air release valves and/or special bag constructions have been used to minimize air within the bag. However, these solutions can substantially complicate (and slow-down) the bag-making process, and/or can significantly increase production costs.

SUMMARY OF THE INVENTION

The present invention provides a release valve for a food bag that supplies sufficient (and possibly superior) freezer-burn protection and can be easily fabricated and incorporated into existing food bag designs. The food bag does not require any special bag constructions, as almost any bag construction can be modified to accommodate the release valve by simply forming an appropriately placed opening. Moreover, the bag structure and the valve can be manufactured separately, by different manufacturers and at different locations. This allows bag-manufacturers to maintain conventional bag-making techniques and, quite significantly, not compromise current (and quick) bag-making speeds. Also, the bag structures and the valves can be inspected prior to integration whereby a defective valve (or batch) can be scrapped without having to sacrifice an otherwise acceptable bag structure (or run). The flexible manufacturing option provided by the present invention results in lower total costs when compared to, for example, in-line production of both the valve and the bag structure.

More particularly, the present invention provides a method of making a plurality of flexible containers, comprising the steps of manufacturing a plurality of bag structures and separately manufacturing a plurality of valves. The valves are each aligned with an opening in a bag structure so that sealed passageways are formed between the vent layer and the bag structure. The aligned valve is then secured to the bag structures. The aligning step and/or the securing step can be performed automatically by a machine.

The present invention also provides a method of making a plurality of valves each having a vent layer and a sealable area for forming a sealed passageway between the vent layer and a bag structure. The method comprises the steps of providing a vent material (pervious with respect to expected gasses), positioning an adhesive on an inner surface of the vent material in a pattern corresponding to the sealable areas, and cutting the vent material into shapes corresponding to the shape of the vent layer.

The valve-making method can additionally comprise the steps of providing a cover material (impervious with respect to the expected gasses), positioning a vent-to-cover adhesive between the outer surface of the vent material and the inner surface of the cover material, and overlaying the vent material and the cover material so that the outer surface of the vent material is adjacent an inner surface of the cover material and secured thereto by the adhesive. The cover material can be cut during the same cutting step as the vent layer.

The present invention further provides a web comprising at least one valve and a liner to which the valve is temporarily attached for selective removal therefrom for integration into a bag structure. The valve comprises a vent layer pervious with respect to expected gasses and a bag-to-vent adhesive on an inner surface of the vent layer for permanently attaching each valve to the bag structure upon integration. The web preferably comprises a plurality of valves and/or the bag-to-vent adhesive preferably also temporarily attaches the valve(s) to the liner.

These and other features of the invention are fully described and particularly pointed out in the claims. The following description and drawings set forth in detail certain illustrative embodiments of the invention, which are indicative of but a few of the various ways in which the principles of the invention may be employed.

DRAWINGS

DETAILED DESCRIPTION

Figure 1:
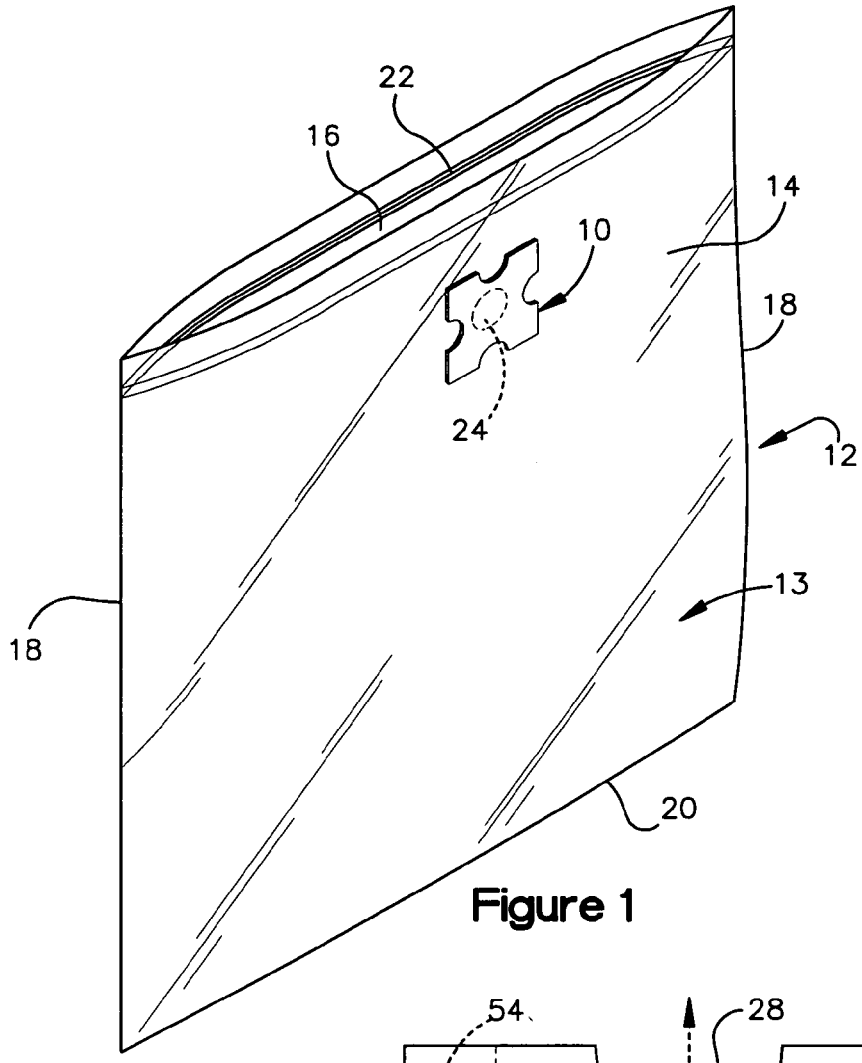
FIG. 1 is a front view of a food bag, which incorporates a valve 10.

Referring now to the drawings and initially to FIG. 1, a valve 10 according to the present invention is shown incorporated into a food bag 12. The food bag 12 can be intended for use as a freezer bag (i.e., to store foods intended to be frozen) and, as is explained in more detail below, the valve 10 supplies sufficient (or even superior) freezer-burn protection. The valve 10 can be easily fabricated and incorporated into existing food bag designs and may find application in "non-freezer-bag" applications as it can help improve freshness and/or reduce space.

The illustrated food bag 12 has a standard bag construction 13 comprising two side panels 14 and 16, each having a rectangular shape (although other geometries are certainly possible). The panels 14 and 16 can be made from a thermoplastic material or a blend of thermoplastic materials such as, for example, polyolefins such as high density polyethylene (HDPE), low density polyethylene (LDPE), linear low density polyethylene (LLDPE), and polypropylene (PP); thermoplastic elastomers such as styrenic block copolymers, polyolefin blends, elastomeric alloys, thermoplastic polyurethanes, thermoplastic copolyesters and thermoplastic polyamides; polymers and copolymers of polyvinyl chloride (PVC); polyvinylidene chloride (PVDC); saran polymers; ethylene/vinyl acetate copolymers; cellulose acetates; polyethylene terephthalate (PET); ionomer (Surlyn); polystyrene; polycarbonates; styrene acrylonitrile; aromatic polyesters; linear polyesters; and thermoplastic polyvinyl alcohols. That being said, the valve 10 of the present invention may be used on other types of plastic bags or any other flexible plastic or non-plastic containers.

The panels 14 and 16 are joined together along side seams 18, a bottom seam 20, and a top seam 22. The preferably permanent seams 18 and 20 can be formed by heat sealing or another suitable technique, forming an air-tight union between the panels 14 and 16. The preferably re-closeable seam 22 can constitute, for example, male/female members, zipper-like members, adhesives, hook-and-loop fasteners, mechanical closures, slide locks, draw string arrangements, fold lock tops, magnetic connections, dead fold closures (i.e., aluminum foil, wire folded, tape), heat seals, staples, handle strings, cable ties and/or twist ties. To prevent freezer burn, it is important that the top seam 22 (as well as the other seams 18 and 20) are airtight to prevent the leakage of air therein. However, the top seam 22 need not be designed to accommodate venting purposes, as in some prior art food bags. Moreover, it is not crucial that the top seam 22 be recloseable, as the present invention could find application in a non-reopenable container having all permanently sealed seams.

The food bag 12 includes an opening 24 on one of its panels (panel 14 in the illustrated embodiment) for registration with the valve 10 of the present invention. In the illustrated embodiment, the opening 24 is located roughly centrally relative to the length of the panel 14 and the width of the panel 16. Also, it has a dimension (e.g., diameter) in the range of about ⅛ inch to about 2 inches, in the range of about ¼ inch to about 1 inch, in the range of about ⅜ inch to about ⅞ inch, in the range of about ½ inch to about ¾ inch, and/or in the range of about ⅜ inch to about ⅝ inch. In the illustrated food bag 12, the opening 24 has a circular shape and is positioned centrally relative to the relevant panel 14. However, other shapes (e.g., slits, slots) or other positions are possible with, and contemplated by, the present invention. In fact, this "opening" need not resemble a hole, but could simply constitute a portion of the bag structure that is pervious to gas by virtue of material-make up, perforations, and/or weave.

Figure 2A:
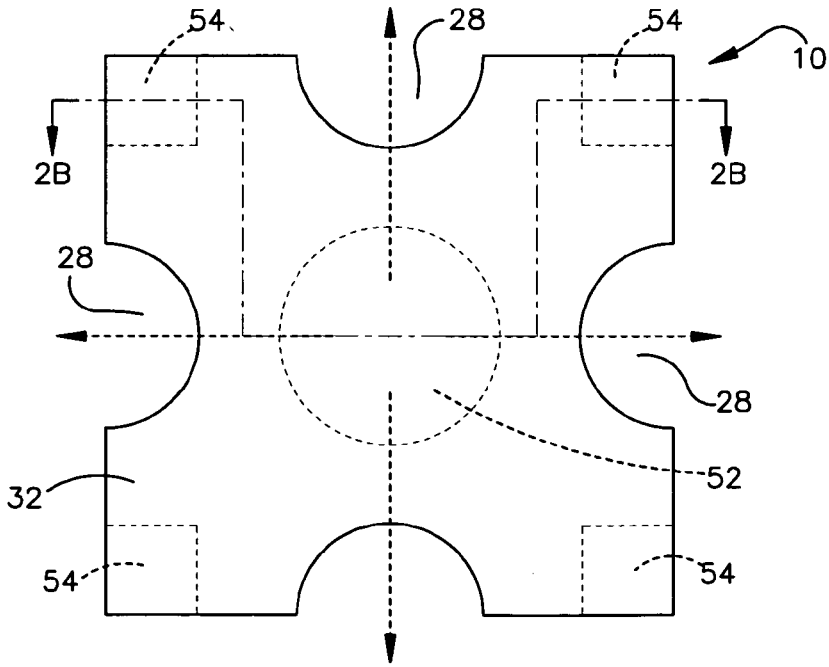
FIGS. 2A-2D are a front view and sectional views of the valve 10.

Referring now to FIGS. 2A-2D, the valve 10 is illustrated as being isolated from the bag structure 12 and, as is best seen in FIG. 2A, it has a roughly square shape with semicircular notches 28 in each side. The overall valve shape can be selected for ease and economy in manufacture (e.g., easily mass-produced with minimal waste), handling, and/or installation, and also to optimize venting, baffling, and leak-prevention. That being said, the overall and/or notched geometry can be changed if necessary or desired, as long as it does not directly effect the venting, baffling, and/or lead-preventing functions. For example, as shown in FIGS. 3A-3D and FIGS. 4A-4D, the valve 10 can instead have a substantially circular and "notchless" shape.

Figure 2B:
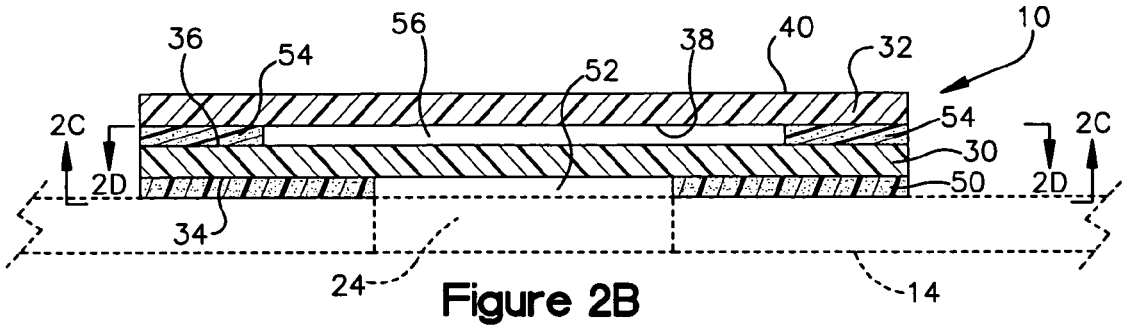

As is best seen in FIG. 2B, the valve 10 comprises a vent layer 30 and a cover layer 32. When installed on the food bag 12 (FIG. 1), the vent layer 30 is the inner layer positioned closest to the bag panel 14 and the cover layer 32 is the outer layer positioned furthest therefrom. The vent layer 30 has an inner surface 34 and an outer surface 36, and the cover layer 32 has an inner surface 38 and an outer surface 40. As is explained in more detail below, baffle passageways 44 between the vent layer 30 and the cover layer 32 for exit paths for gas being released through valve 10.

The vent layer 30 is made of a material that allows expected gasses to escape from the food bag 12 while preventing the escape of expected liquids. ("Expected gasses" refers to gasses such as air and/or air mixed with gas from contents of the bag structure, and "expected liquids" refers to water and/or other liquids from the contents of the bag structure.) More specifically, the vent layer 30 is pervious with respect to the expected gasses while, at the same time, it is substantially impervious to the expected liquids. In the present situation "substantially impervious" refers to the material's ability to contain liquids should they casually come into contact therewith, but not necessarily the ability to prevent leakage should the material become saturated, should wicking action occur, and/or should strategic squeezing be performed to create a high pressure force in the vicinity of the opening 24. A balance should be maintained for each particular application between sufficient gas flow capacity and adequate liquid leakage protection.

The cover layer 32 serves as a baffle layer that guides escaping gas when pressure is placed on the closed food bag 12. However, a cover layer 32 may not be needed in some applications, as the vent layer 30 alone may perform adequate valve functions. The cover layer 32 can also serve as a supplemental liquid barrier so that, in combination with the liquid-impervious qualities of the vent layer 30, an increased shield is created.

Perhaps it should be noted at this point that liquid-leakage issues may not be significant in all relevant situations. For example, in situations where food that has already been frozen (e.g., frozen fish, frozen meat, etc.) is being repackaged for future freezing, the containment of liquid from within the bag 12 will not be a concern. In these circumstances, the liquid-imperviousness of the vent layer 30 would be less of a design consideration. Conversely, liquid-leakage issues may play more of a significant role in the desire for the food bag 12 to be compatible with non-freezer applications, such as temporarily storing liquid food substances such as soup or pasta sauce.

Figure 2C:
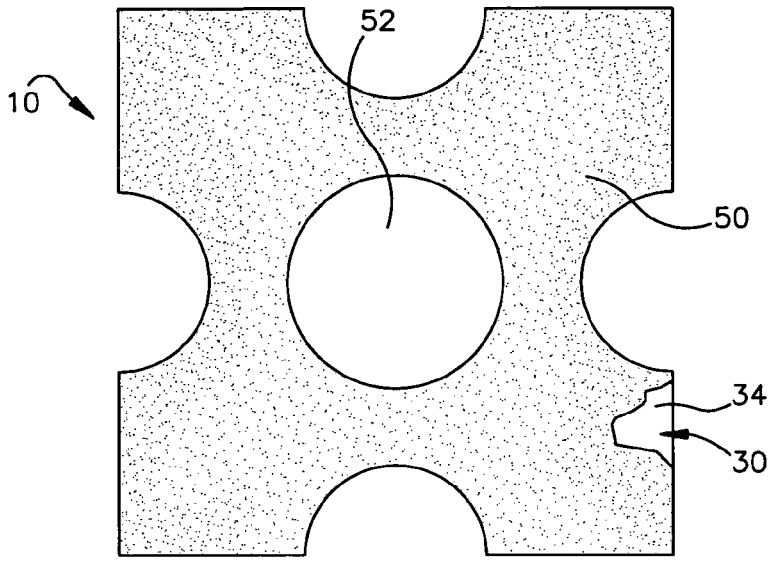
Figure 2D:
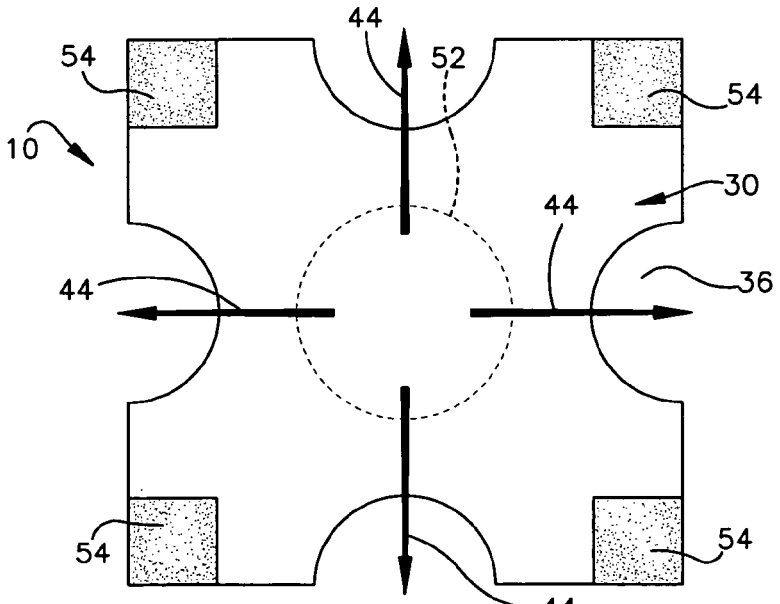

Preferably the size/shape of the layers 30 and 32, and their relative positioning relative to each other, is such that the perimeter (i.e., the periphery) of the cover layer 32 does not extend beyond the perimeter (i.e., the periphery) of the vent layer 30. (FIGS. 2B-2D.) In this manner, the inner surface 34 of the vent layer 30 can form the entire inner surface, or attachment surface, of the valve 10. As is explained in more detail below, this feature of the invention contributes to efficient and economic integration of the valves 10 into the bag structures 13. More preferably, the layers 30 and 32 are of substantially the same shape and size, and are substantially aligned with each other. As is explained in more detail below, this contributes to the efficient and economic mass-manufacturing of the valves by allowing simultaneous cutting of the layers 30 and 32, and preferably also the notches 28. As for the circular and "notchless" valves 10 shown in FIGS. 3 and 4, the circumference (i.e., the periphery) of the cover layer 32 does not extend beyond the circumference (i.e., the periphery) of the vent layer 30 and, more particularly, the layers 30 and 32 are of substantially the same circular shape and size, and are substantially aligned with each other.

An adhesive area 50 on the inner surface 34 of the vent layer 30 attaches the valve 10 to the bag structure 13. The adhesive area 50 covers the inner surface 34, except for an adhesive-free area 52 corresponding to the opening 24 in the food bag 12. (FIGS. 2B and 2C.) In the illustrated embodiment, the adhesive-free area 52 is circular and is sized for close registration with the opening 24 (e.g., ⅝ inch diameter). However, other shapes (mirroring or not mirroring the bag opening 24) and/or not-so-precise registration could be used instead.

It may be noted that the two-fold purpose of the adhesive area 50 is to attach the vent layer 30 to the bag structure 12 and to seal the central area 52 so that expelled fluid will pass through the vent layer 30 to the area 56 and exit through the baffle passageways 44. Thus, any adhesive and/or any adhesive pattern that provides this attaching/sealing could be used. In fact, non-adhesive attachments/sealings accomplishing these same goals are possible with, and contemplated by, the present invention.

An adhesive area 54 between the outer surface 36 of the vent layer 30 and the inner surface 38 of the cover layer 32 attaches these layers together. In the illustrated embodiment, the adhesive area 54 comprises four squares occupying each of the four corner sections of the surface 36. (FIGS. 2B and 2D.) As with the adhesive area 50, any adhesive or non-adhesive arrangement which provides such attaching is possible with, and contemplated by, the present invention.

The adhesive-free area 56 between the vent layer 30 and the cover layer 32 extends to side edge portions of the valve 10, whereby the traverse baffling passageways 44 are formed for the escaping gas. Specifically, gas flow traveling through the portion of the vent layer 30 that is aligned with the bag opening 24 (and/or the adhesive-free area 52) will be turned perpendicularly by the cover layer 32 and released through the baffling passageways 44 between the layers 30 and 32. It may be further noted that in the illustrated embodiment the notches 28 help to insure a cross-shaped release of gas, thereby equalizing exhaust forces and not straining the valve-to-bag attachment.

Figure 3A:
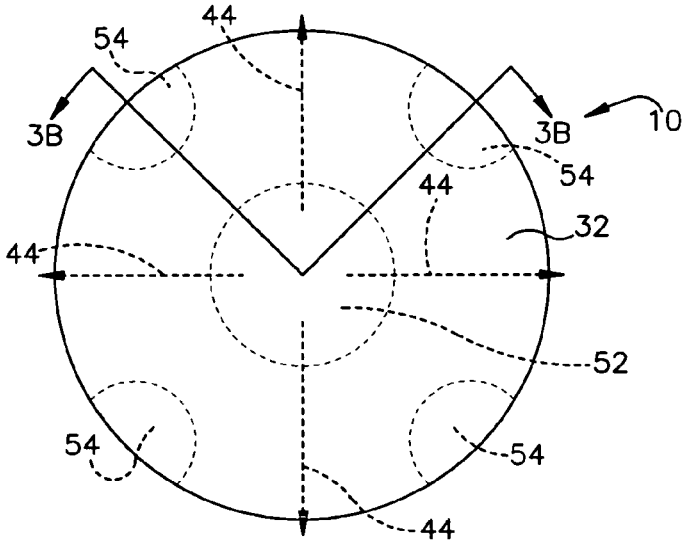
FIGS. 3A-3D are a front view and sectional views of a modified form of the valve 10.
Figure 3B:
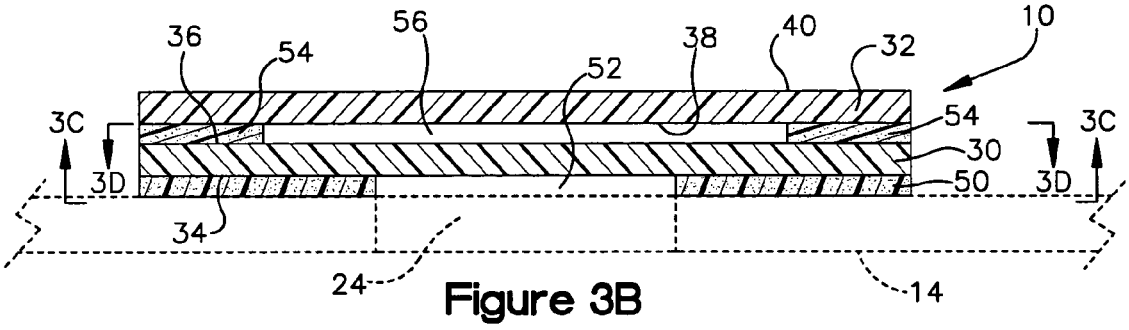
Figure 3C:
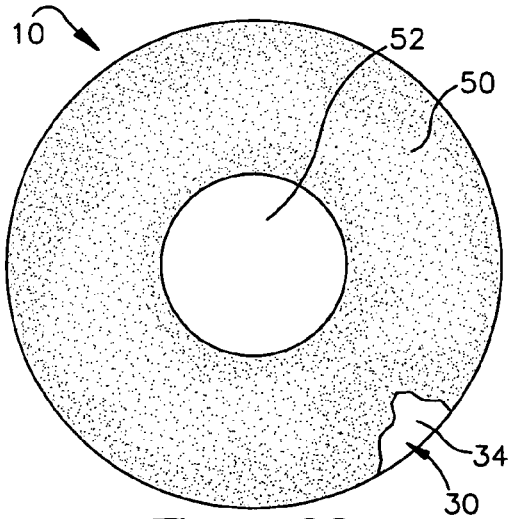
Figure 3D:
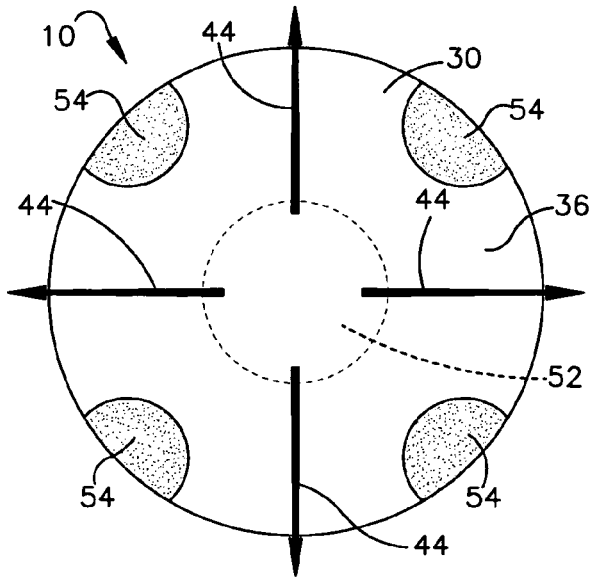
Figure 4A:
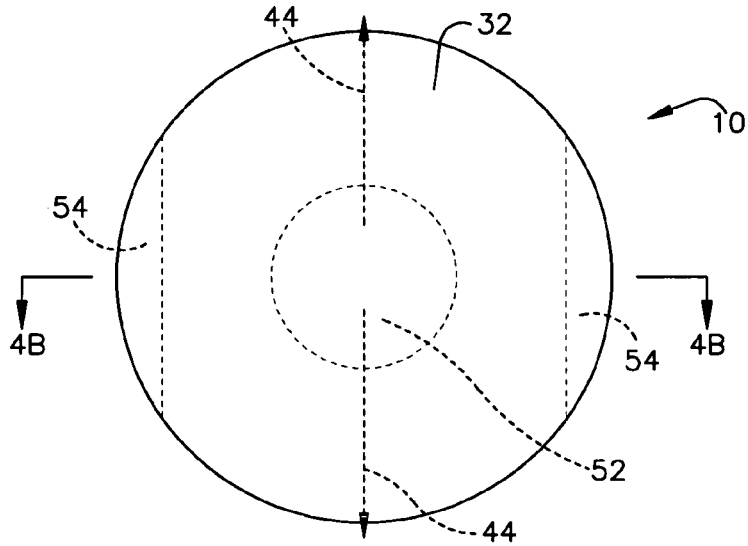
FIGS. 4A-4D are a front view and sectional views of another modified form of the valve 10.
Figure 4B:
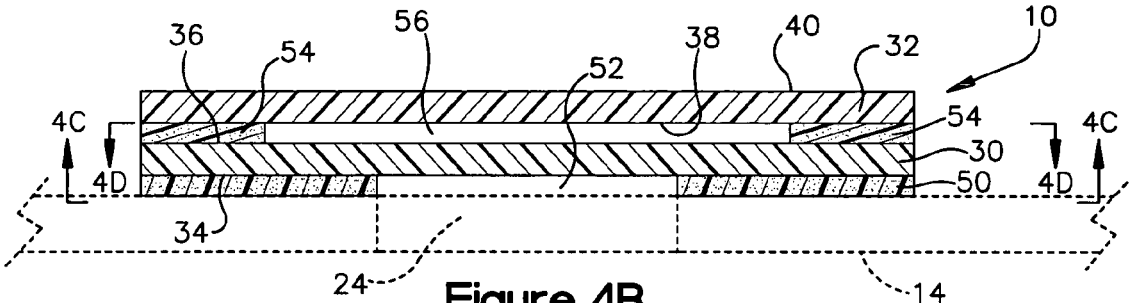
Figure 4C:
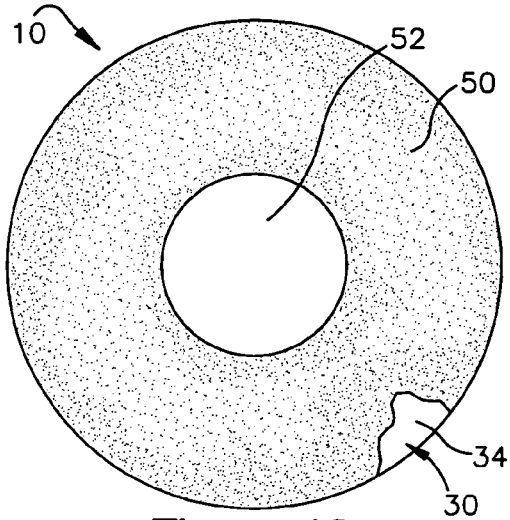
Figure 4D:
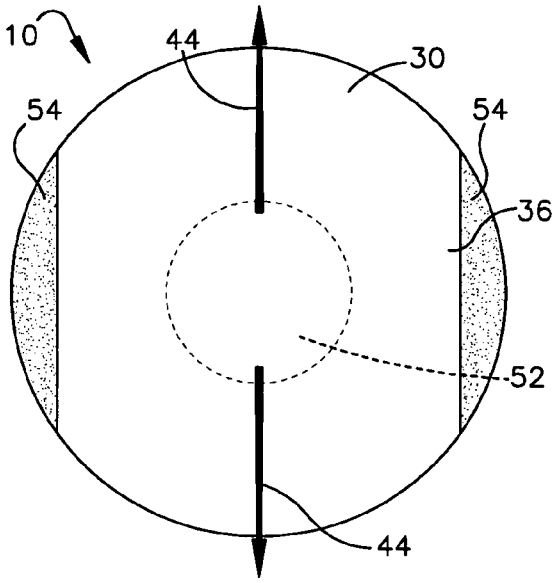

Other adhesive (or non-adhesive) arrangements which result in the baffling passageways 44 being formed between the layers 30 and 32 are certainly possible with, and contemplated by, the present invention. For example, in the circular valve shown in FIGS. 3A-3D, the adhesive area 54 comprises four semi-circles equally spaced about the circle's circumference. (FIG. 3D.) In the circular valve shown in FIGS. 4A-4D, the adhesive area 54 comprises two strips running through opposite side arcs of the circle. (FIG. 4D.) As is explained in more detail below, these adhesive arrangements might be more mass-manufacturing friendly, as they allow dot patterns and stripe patterns, respectively, to be used during the adhesive-applying step.

Figure 5A:
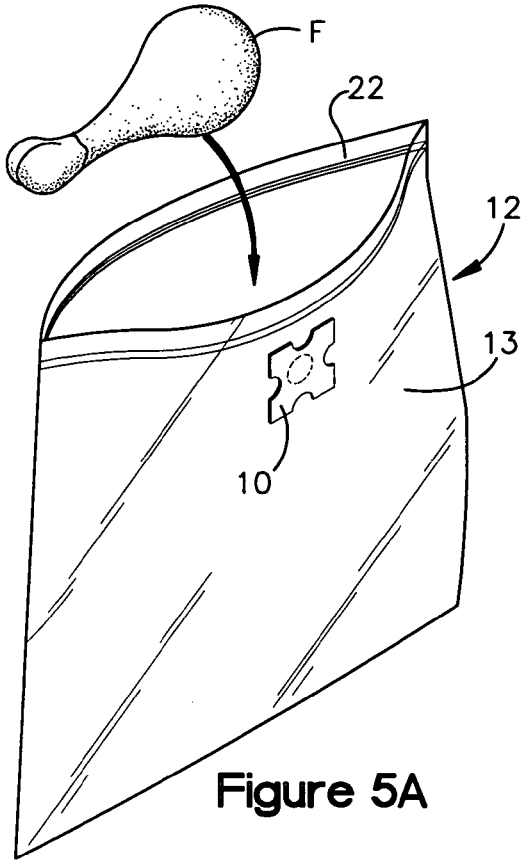
FIGS. 5A-5D are schematic views showing a method of using the food bag to store food for later consumption.
Figure 5B:
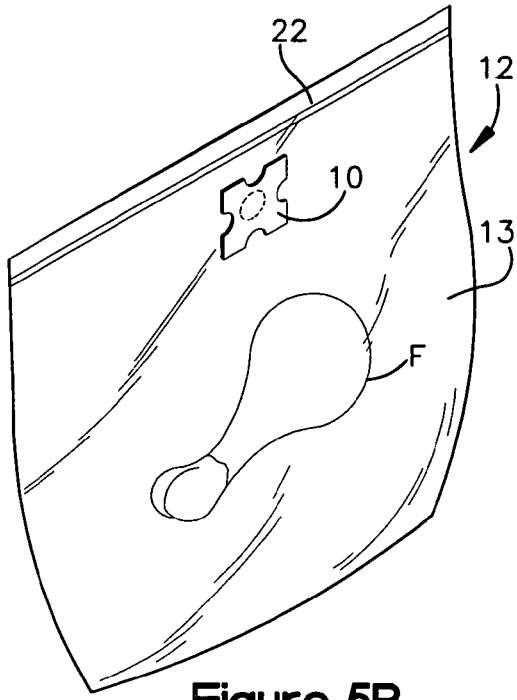
Figure 5C:
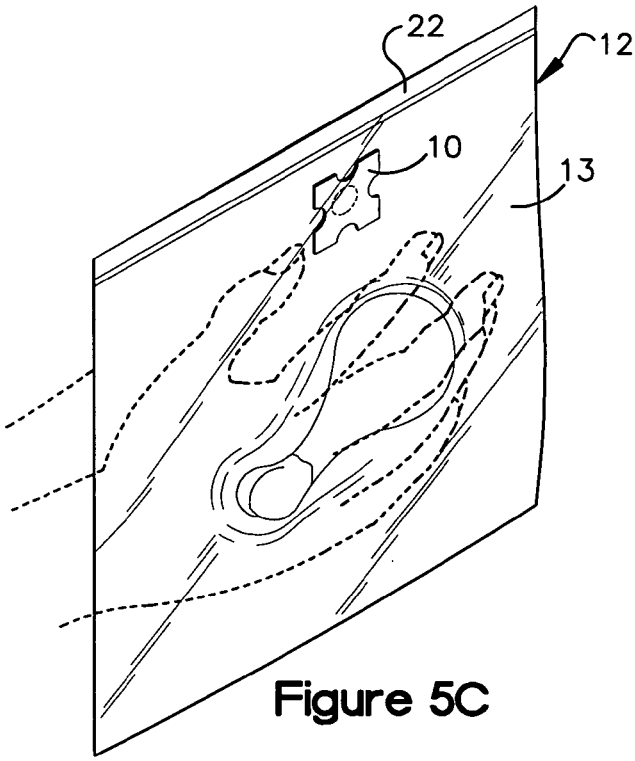
Figure 5D:
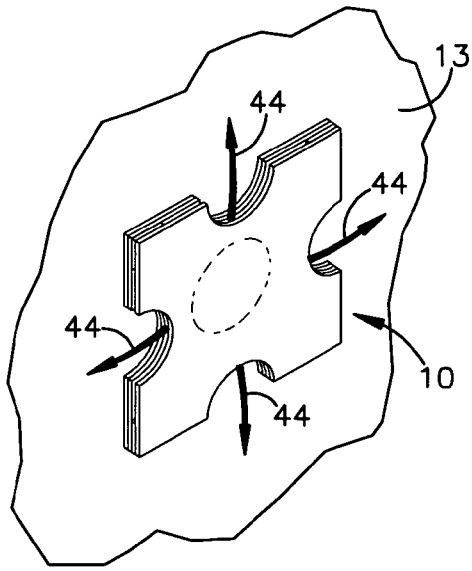

As shown in FIGS. 5A-5D, the illustrated bag 12 can be used by a consumer, in a home setting, to store food for freezing. According to the present invention, food F is placed in the bag structure 13 and the top seam 22 is closed. (FIGS. 5A and 5B.) Pressure is then applied to the bag structure 13 (e.g. by manually pushing or squeezing the bag structure 13) at a location lower than the valve 10. (FIG. 5C.) Gas (e.g. air) within the bag structure 13 then passes through the opening 24, through the vent layer 30, and released through the baffling passageways 44 between the layers 30 and 32. (FIG. 5D.)

Referring now to FIGS. 6A-6J, a method for mass-manufacturing a plurality of the food bags 12 according to the present invention is schematically shown. In this method, a plurality of the valves 10 is manufactured, a plurality of the bag structures 13 is manufactured separately and in a conventional manner, and the valves 10 are integrated into the structures 13 during the latter stages of bag production. While the illustrated schematic steps are shown with respect to a single row of valves 10 and/or bag structures 13, these steps can, of course, be performed simultaneously or intermittently to a plurality of rows for mass production purposes.

Figure 6A:
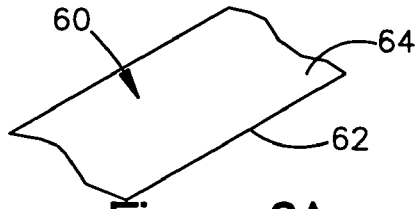
FIGS. 6A-6J are schematic views showing a method of making the food bag 12 according to the present invention.
Figure 6B:
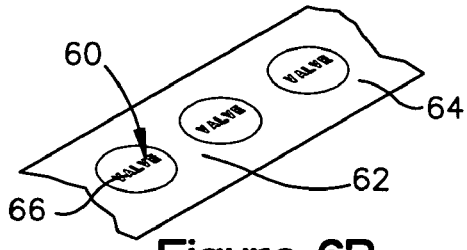
Figure 6C:
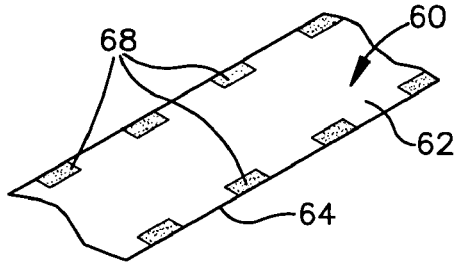
Figure 6D:
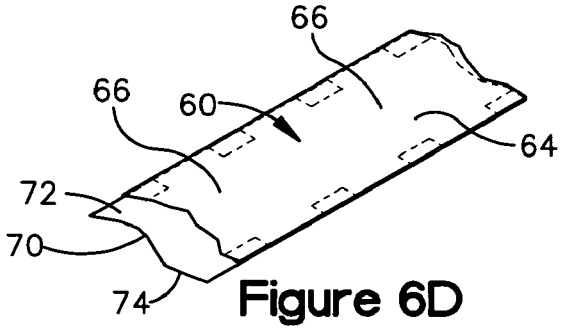

To manufacture the valves 10, a continuous web of cover material 60 is provided having an inner surface 62 and an outer surface 64. (FIG. 6A.) A commercial indication, a name brand, a logo or other labeling indicia 66 is printed on the outer surface 64. (FIG. 6B) An adhesive 68 is applied (e.g., printed) on the inner surface 62 of the cover material 60 in a pattern corresponding to the adhesive areas 54. (FIG. 6C.) A continuous web of a vent material 70 having an inner surface 72 and an outer surface 74 is then positioned so that its outer surface 74 is adjacent the inner surface 62 of the cover material 60, whereby the adhesive 68 is positioned therebetween. (FIG. 6D.)

Figure 6E:
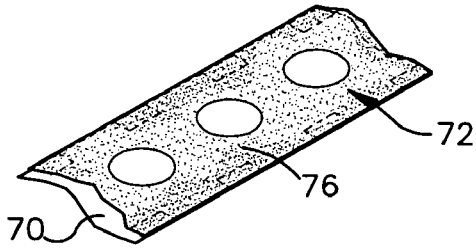
Figure 6F:
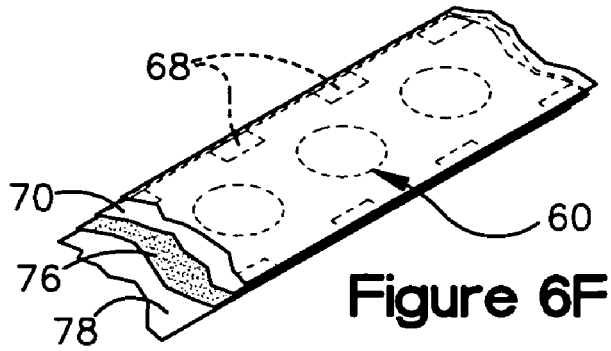
Figure 6G:
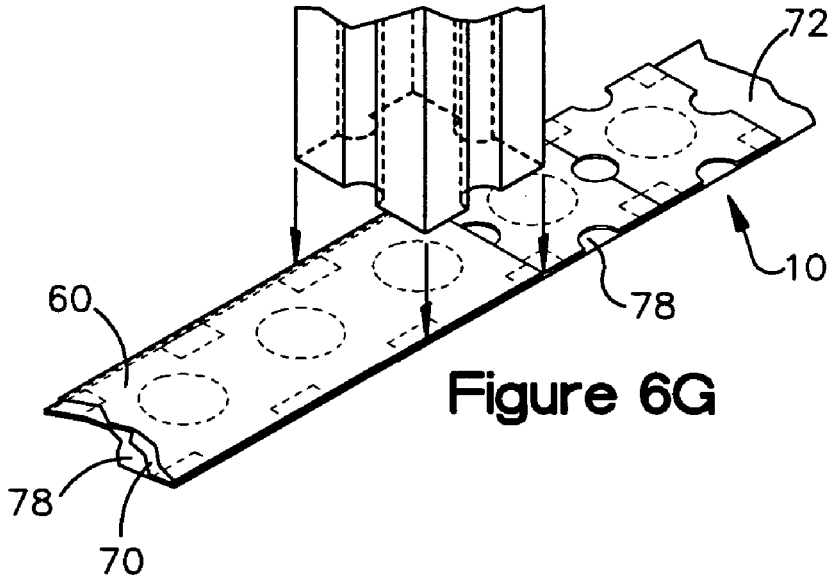
Figure 6H:
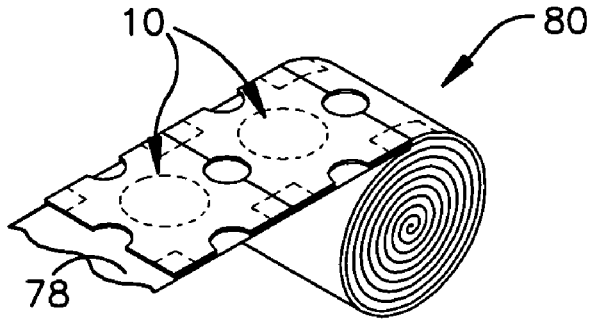

An adhesive 76 is applied (e.g., printed) to the inner surface 72 of the vent material 70 in a pattern corresponding to the adhesive areas 50 in the valves 10. (FIG. 6E.) A release liner 78 is positioned over the inner surface 72 of the vent material 70 so that the adhesive 76 is positioned therebetween. (FIG. 6F.) The compilation of materials 60 and 70 is then die cut into squares corresponding to the overall shape of the valves 10 and, preferably simultaneously, cut to form the notches 28. (FIG. 6G.) The cuts do not extend through the release liner 78 whereby a web 80 comprising a plurality of the valves 10 temporarily attached to the release liner 78 (via the adhesive 76 or the adhesive area 50) is produced. (FIG. 6H.) The web 80 can be shipped from the valve-manufacturing location to the bag-manufacturing location in, for example, roll form.

Figure 6I:
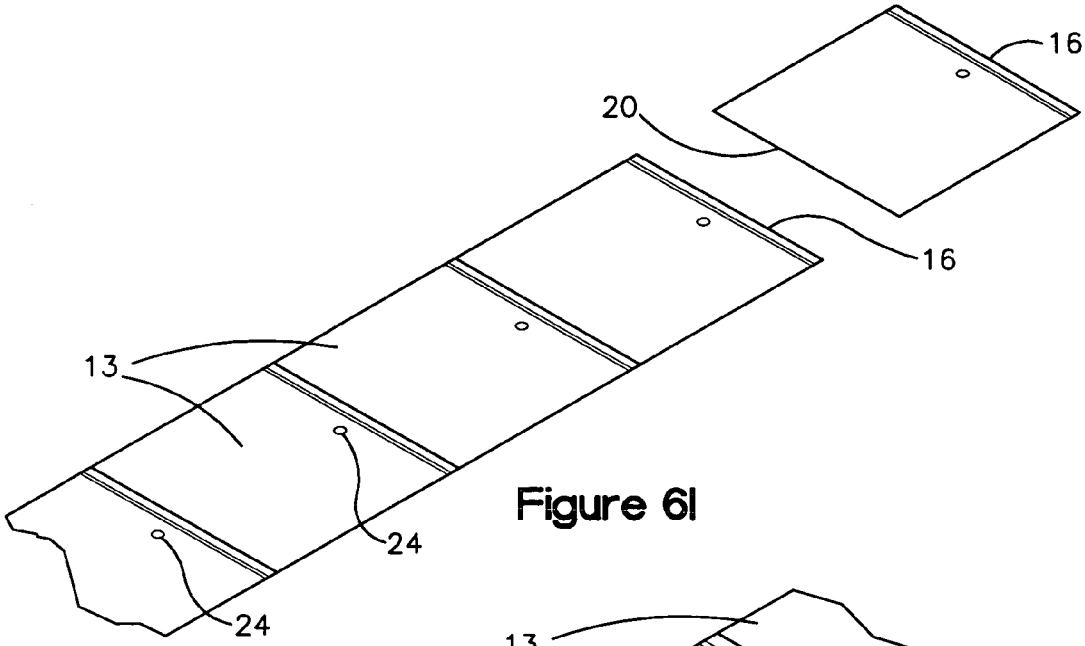
Figure 6J:
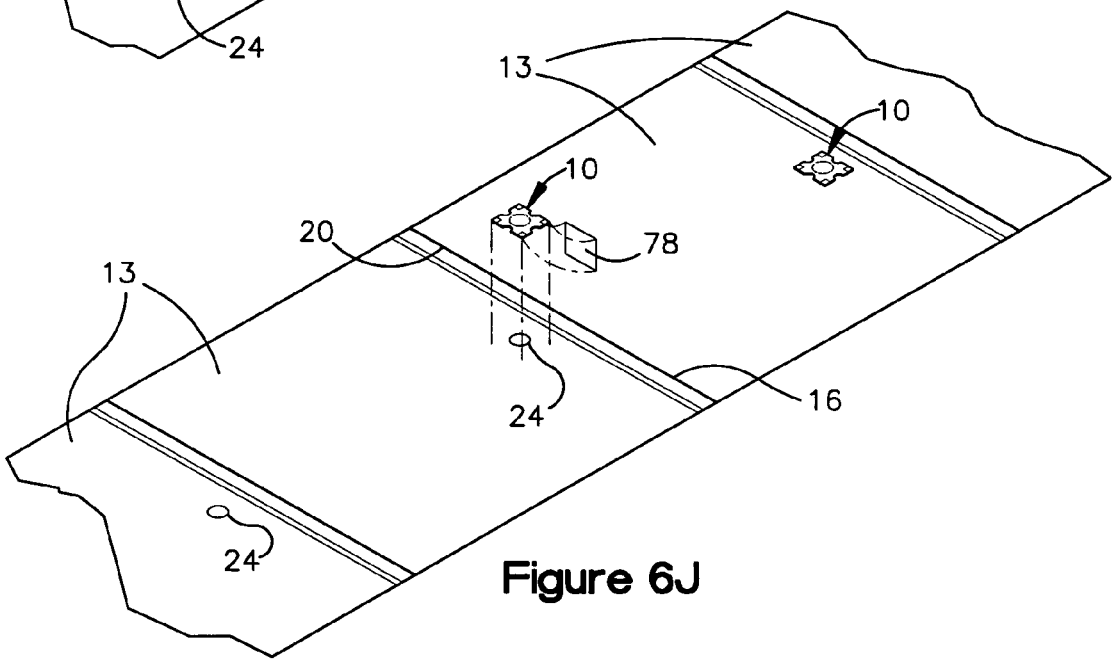
Figure 7:
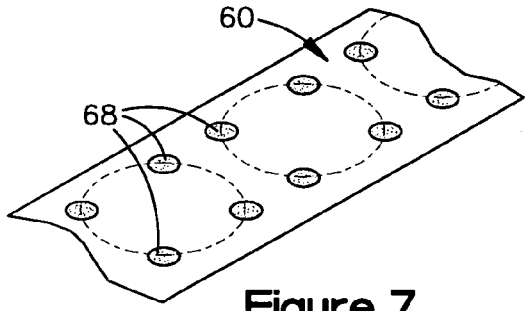
FIG. 7 is a schematic view of an adhesive-applying step for the valve 10 shown in FIGS. 3A-3D.
Figure 8:
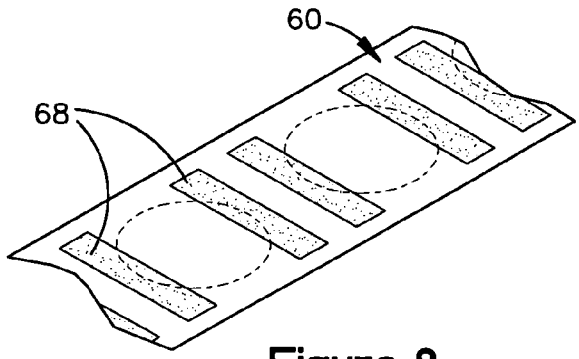
FIG. 8 is a schematic view of an adhesive-applying step for the valve 10 shown in FIGS. 4A-4D.
Figure 9:
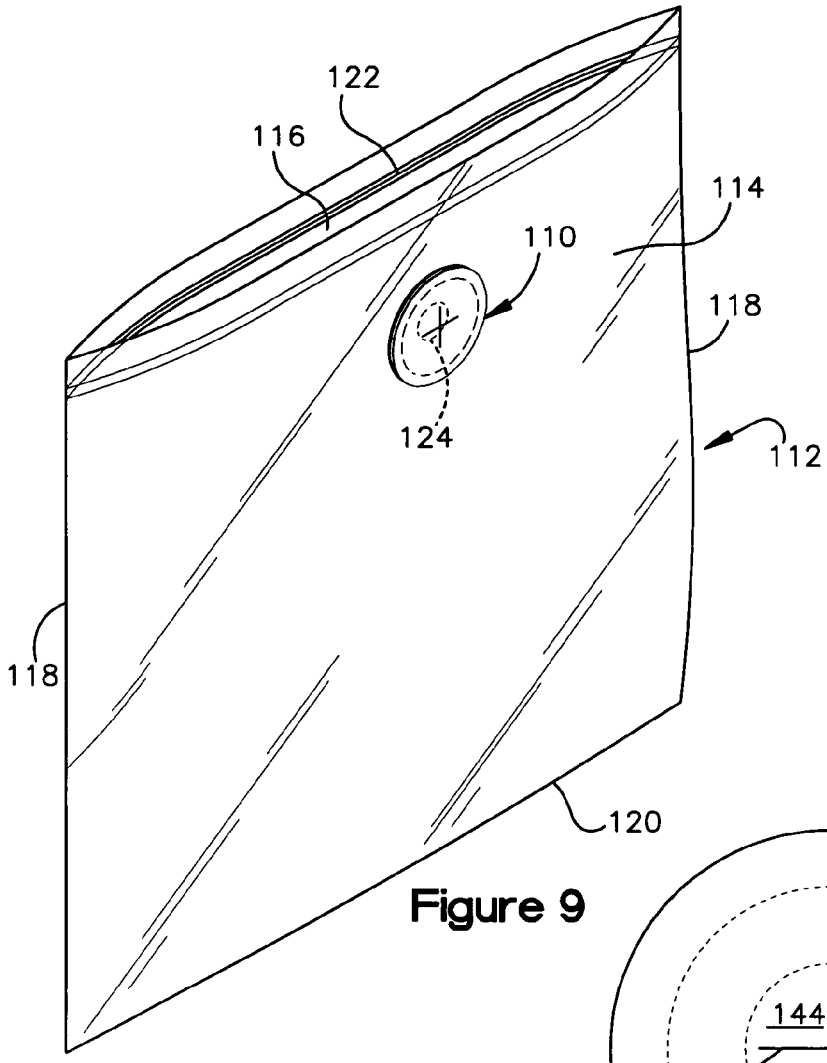
FIG. 9 is a perspective view of a food bag 112 incorporating a valve 110 according to the present invention.

The bag structures 13 are separately mass-manufactured in a continuous strip wherein the bottom seam 20 of one bag structure 13 abuts against the top seam 22 of the adjacent downstream bag structure 13. (FIG. 6I). The valves 10 can be removed from the release liner 78, aligned with the openings 24 and secured to the bag structures 13 (FIG. 6J). The removal, aligning, and securing step can be performed automatically (i.e., by a machine, not shown) or can be performed manually (i.e., by a person, not shown). The bag structures 13 are separated from each other by a severing device (not shown), either before or after the valve-securing step.

Thus, the present invention allows the bag structure 13 and the valve 10 to be manufactured as separate articles and integrated together during final production stages. This allows the bag structure 13 to be made in a conventional (and quick and proven cost-effective) manner whereby the integration of the valve 10 does not significantly affect the bag-making process. Additionally or alternatively, the valves 10 can be inspected prior to integration whereby potentially defective items can be pulled from the process without having to scrap entire otherwise acceptable bag structures 13. (Likewise, the bag structures 13 can be inspected prior to integration to avoid the scraping otherwise acceptable valves 10, however, the cost of the bag structure 13 will usually greatly outweigh the cost of the valve 10.) The flexible manufacturing option provided by the present invention results in lower total costs when compared to, for example, in-line production of both the valve and the bag structure.

The cover material 60 (and thus the cover layer 32) can be made from polymer film materials such as polystyrenes, polyolefins, polyamides, polyesters, polycarbonates, polyvinyl alcohol, poly(ethylene vinyl alcohol), polyurethanes, polyacrylates including copolymers of olefins such as ethylene and propylene with acrylic acids and esters, copolymers of olefins and vinyl acetate, ionomers and mixtures thereof. One particular example is a biaxially-oriented semi-crystalline polymerfilm comprising isostatic polypropylene, also referred to as biaxially-oriented polypropylene (BOPP).

The vent material 70 (and thus the layer 30) can be made from nylon, polyolefins (e.g., polyethylene, polypropylene, ethylene butylene copolymers), polyurethanes, polyurethane foams, polystyrenes, plasticized polyvinylchlorides, polyesters, polyamides, cotton, or rayon. The vent material can be woven, non-woven, knitted and/or an aperatured (or perforated) film. Preferably, the material used to fabricate the vent layer 30 should have a porosity or perviousness of at least about 5 cfm (cubic feet per minute), at least about 10 cfm, at least about 15 cfm, at least about 20 cfm and/or at least about 25 cfm with respect to air so that an acceptable level of gas flow can be obtained without the placement of excessive pressure on the bag.

The adhesive 68 (and thus the adhesive area 54) can be any suitable adhesive, such as a pressure-sensitive adhesive (e.g., acrylic-based, rubber-based, or silicone-based) or a curable-adhesive, such as a UV-curable adhesive. (It may be noted that if a UV-curable adhesive is used for the adhesive 76, the cover material 68 may need to be transparent.)

The adhesive 76 (and thus the adhesive area 50) can be any suitable adhesive, such as a pressure-sensitive adhesive (e.g., acrylic-based, rubber-based, or silicone-based) and, more particularly, a hot melt pressure-sensitive adhesive.

The release liner 78 can be a sheet of paper or polymeric film having a release coating, such as a silicone release coating.

It may be noted that another consideration for material selection with respect to the vent layer 30, the cover layer 32, the adhesive 50, the adhesive 54, and/or the release liner 78, may stem from the potential food-related use of the food bag 12. Specifically, the FDA may dictate that only certain materials and/or adhesives can be used when the possibility of food contact exists. Furthermore, if the food bag 12 is intended to be used as a freezer bag, the materials should be able to remain intact at the expected freezing temperatures. Also, with particular reference to the adhesive 50 (used to attach the valve 10 to the bag structure 13), an important consideration might be whether the valves 10 will be automatically or manually attached to the bag structures 13.

Referring now to FIGS. 9-14, another valve 110 according to the present invention is shown. The valve 110, the food bag 112 and the bag structure 113 are similar in many ways to the valve 10, the bag 12, and the structure 13 whereby like reference numerals, with a "100" added thereto, are used to designated like parts.

Figure 11:
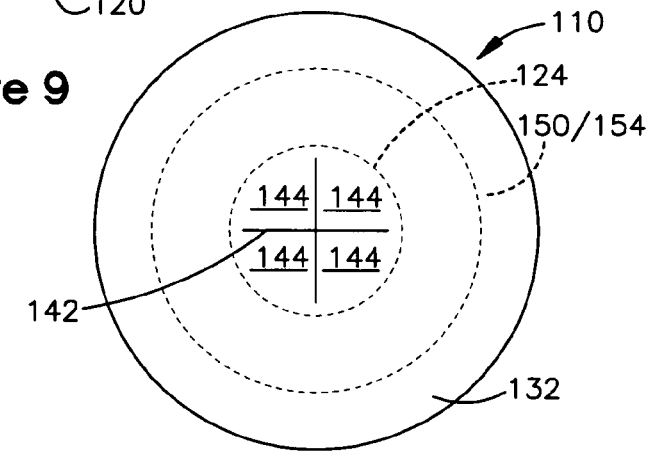
FIG. 11 is a front view of the valve 110 isolated from the rest of the food bag 112.
Figure 10:
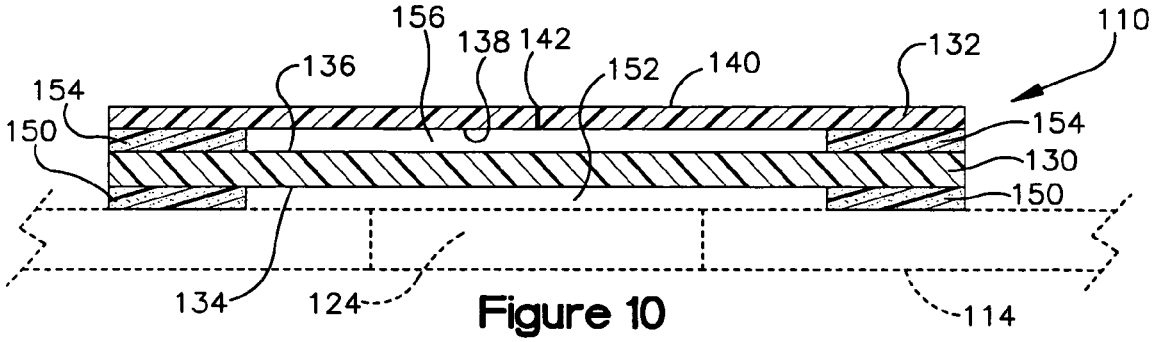
FIG. 10 is a close-up sectional view of the food bag 112.

The valve 110 has a circular shape (in plan) dictated by the circular shape of its vent layer 130 and its cover layer 132. (FIGS. 10 and 11.) As with the layers 30 and 32, the circumference (i.e., the periphery) of the cover layer 132 does not extend beyond the circumference (i.e., the periphery) of the vent layer 130 and the layers 130 and 132 are preferably of substantially the same shape and size, and are substantially aligned with each other.

The valve 110 does not have baffle passages, but instead has a cross-shaped slit 142 that extends through the thickness of the cover layer 132 (i.e., from its inner surface 138 to its outer surface 140) thereby defining a plurality (i.e., four) of flaps 144. (FIG. 11.) As is best seen by referring briefly to FIG. 12D, the flaps 144 are lifted relative to the rest of the cover layer 132 when gas is being released through the valve 110.

Figure 12A:
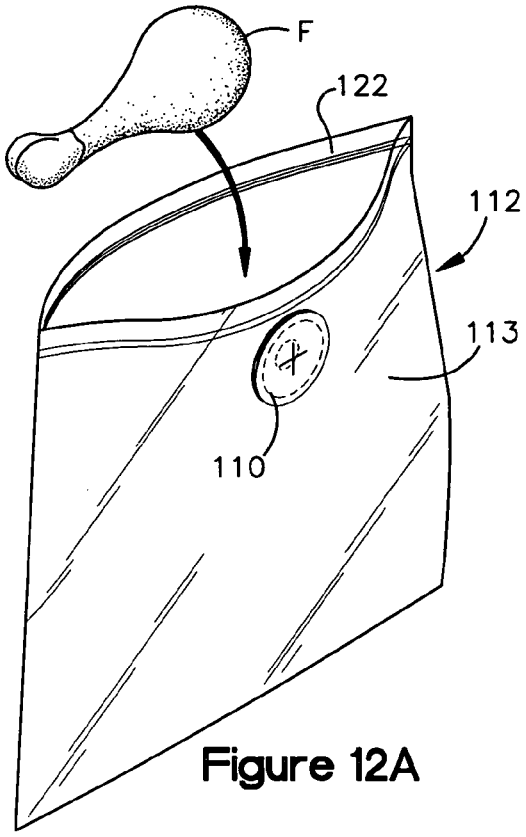
FIGS. 12A-12D are schematic views showing a method of using the food bag 112 to store food for later consumption.
Figure 12B:
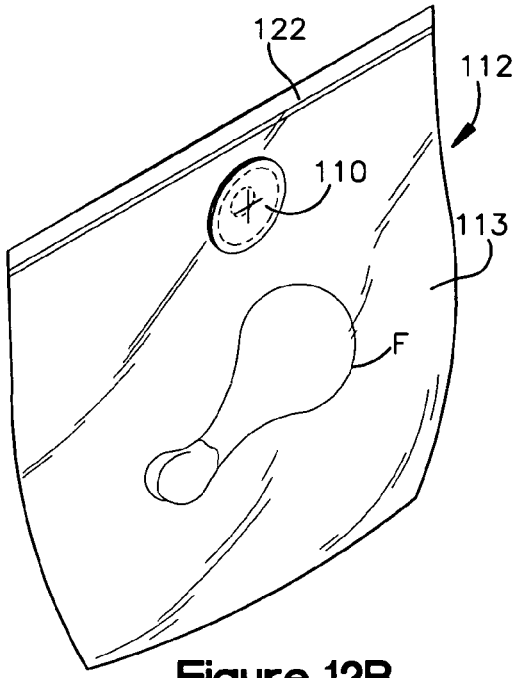
Figure 12C:
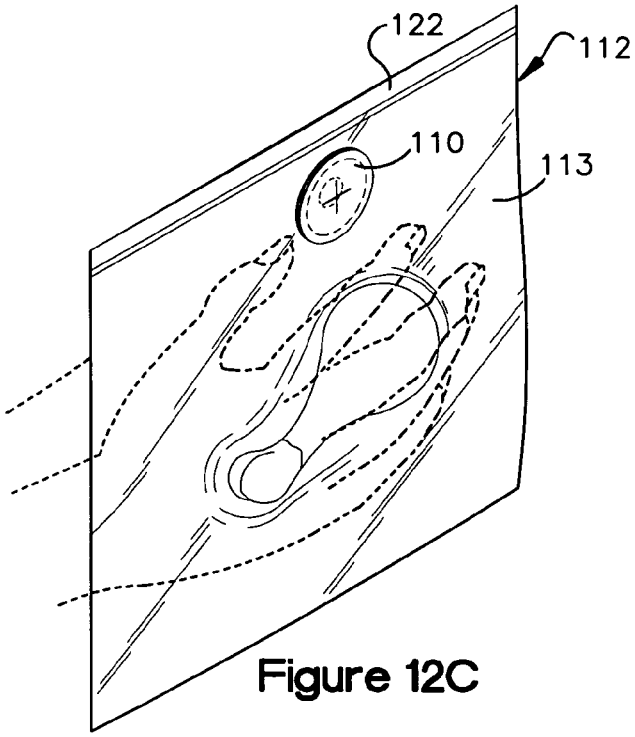
Figure 12D:
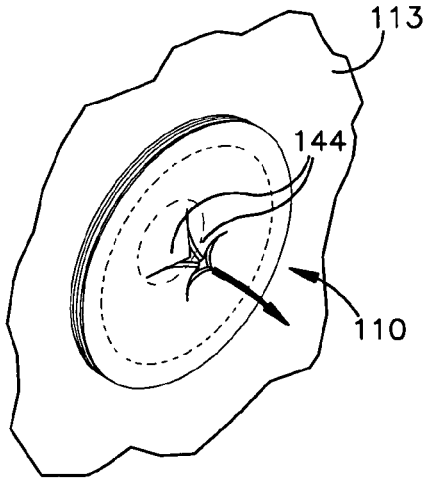

The adhesive area 154 has an annular shape bordering the periphery of the circular outer surface 136 and surrounding (and sealing) the adhesive-free central area 156. A portion of the adhesive-free area 156 is aligned with the adhesive-free area 152 and another (or the same) portion is aligned with the flaps 144. The adhesive area 154 is intended to attach the cover layer 132 to the vent layer 130 and to seal the central area 156 so that the released gas will pass through the flaps 144. As shown in FIGS. 12A-12D, the food bag 112 can be used by a consumer, in a home setting, to store food for freezing. Gas (e.g. air) within the bag structure 113 will pass through the opening 124 to the adhesive-free area 152, through the vent layer 130 to the adhesive-free area 156, through the slits 142 thereby lifting the flaps 144 to escape to the atmosphere. (FIG. 12D.) The adhesive-free areas 152 and 156 can be viewed as "sealed areas" which provide passageways from the bag opening 124 to the exit slits 142.

Figure 13A:
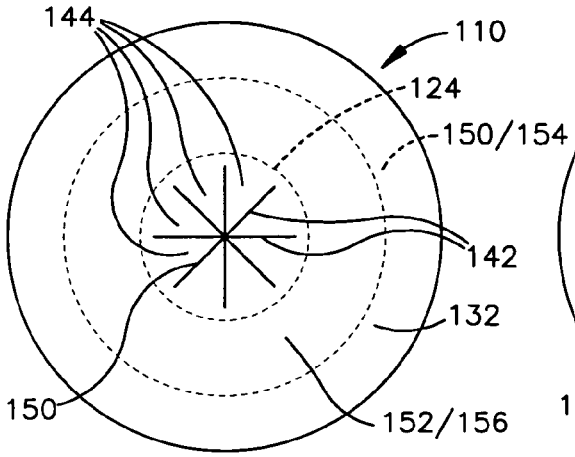
FIGS. 13A-13F are isolated front views of modified versions of the valve 110.
Figure 13B:
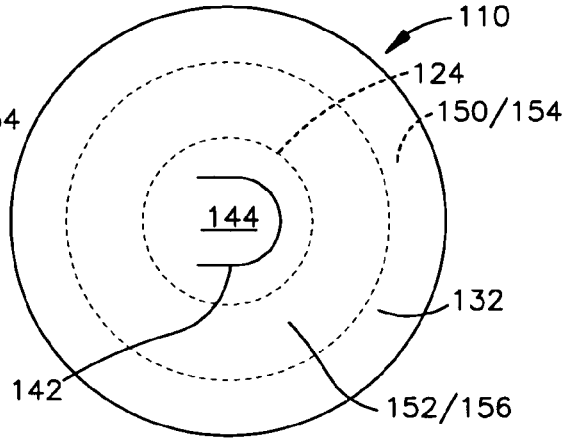
Figure 13C:
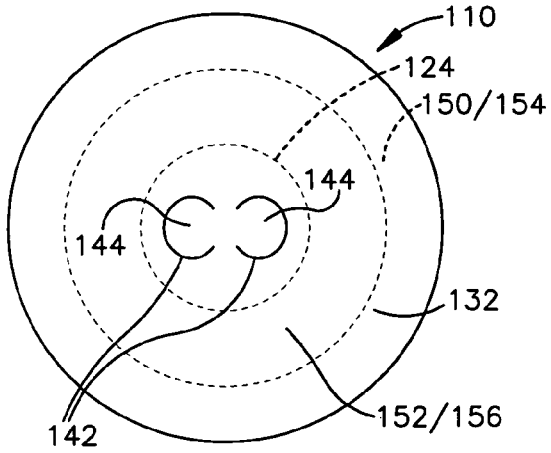
Figure 13D:
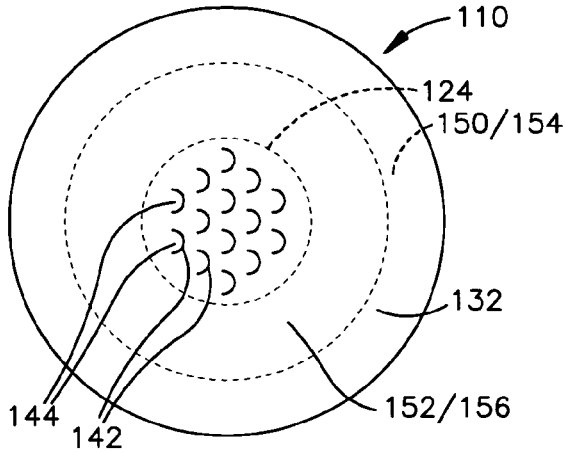
Figure 13E:
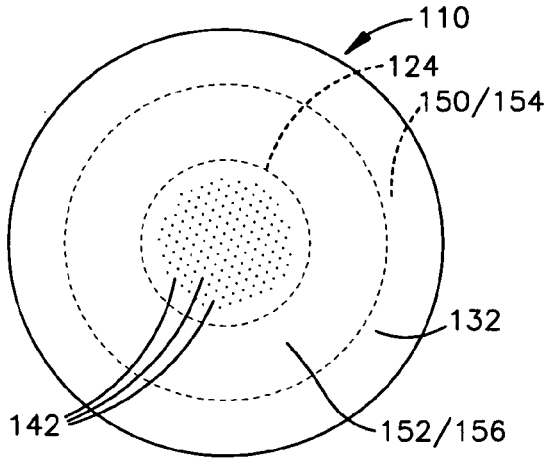
Figure 13F:
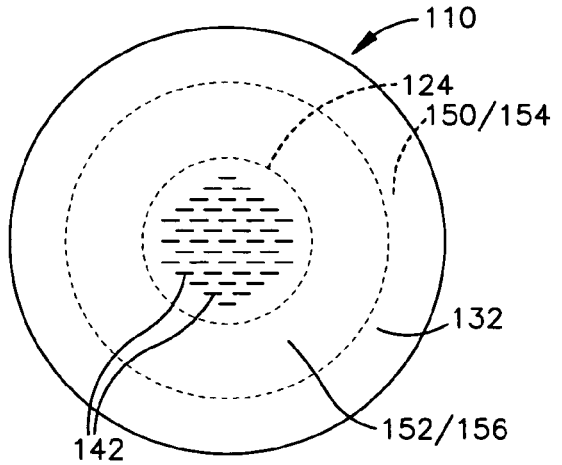

In the valve 110 shown in FIGS. 9-12, the cross slit 142 forms four triangular flaps 144 which lift to release the expelled gas. Other types of slits 142, forming other types of flaps 144, are certainly possible with and contemplated by, the present invention, such as those shown in FIGS. 13A-13D. Specifically, for example, an overlapping-cross slit 142 can form eight triangular flaps 144 (FIG. 13A), a half-capsule slit 142 can form a correspondingly half-capsule flap 144 (FIG. 13B), a pair of ear-shaped slits 142 can form correspondingly ear-shaped flaps 144 (FIG. 13C), and a series of semi-circular slits 142 can form a plurality of semi-circular flaps 144 (FIG. 13D). Moreover, the slit(s) 142 need not form flaps 144, as they can have "flapless" design wherein the slit(s) 142 comprise, for example, perforations (FIG. 13E) or linear cuts (FIG. 13F), allowing the released gas to escape therethrough.

Figure 14A:
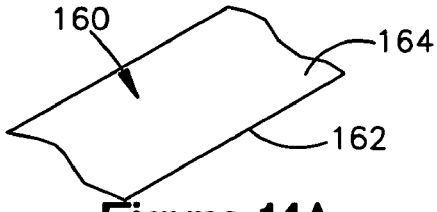
FIGS. 14A-14J are schematic views showing a method of making the food bag 112 according to the present invention.
Figure 14B:
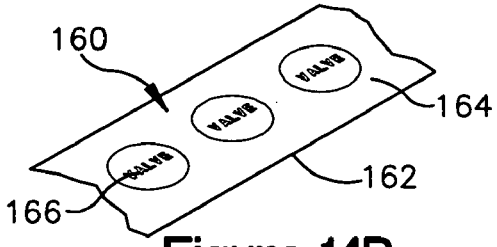
Figure 14C:
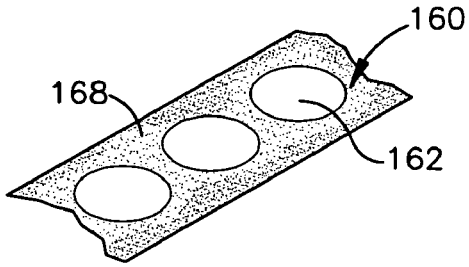
Figure 14D:
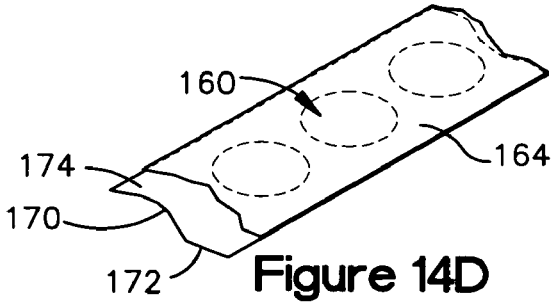
Figure 14E:
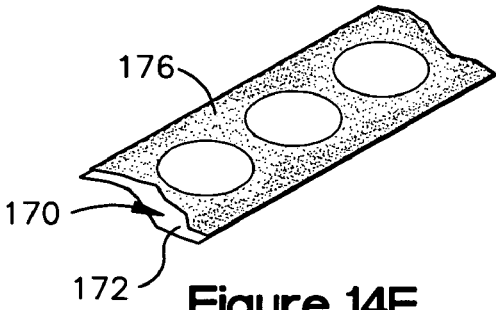
Figure 14F:
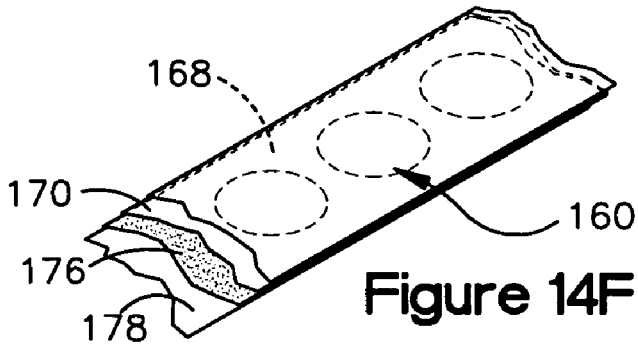
Figure 14G:
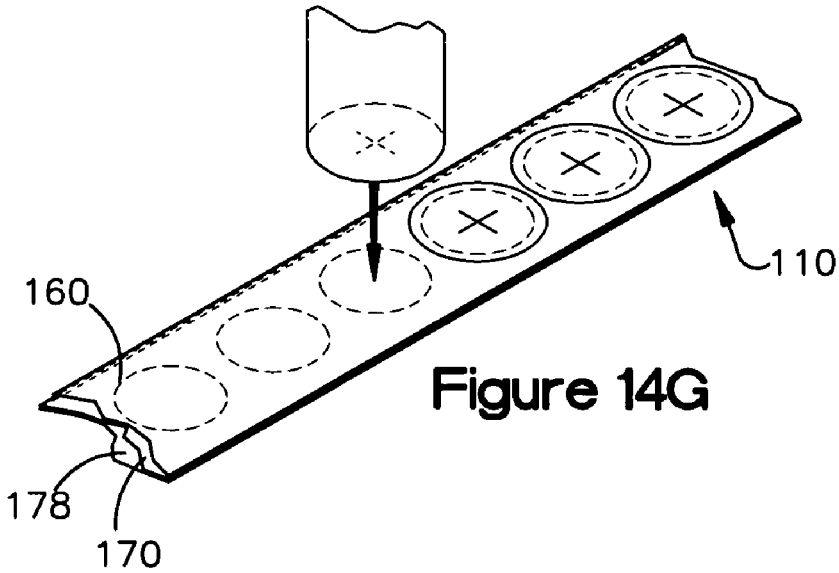
Figure 14H:
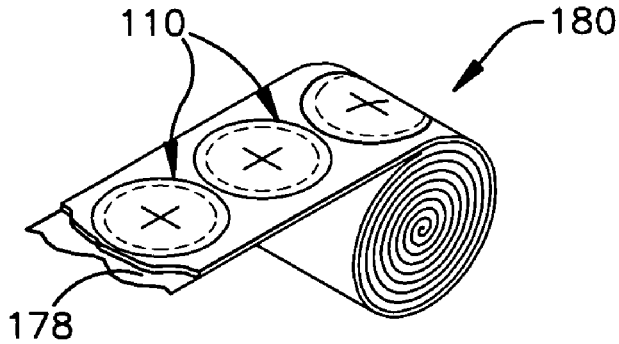
Figure 14I:
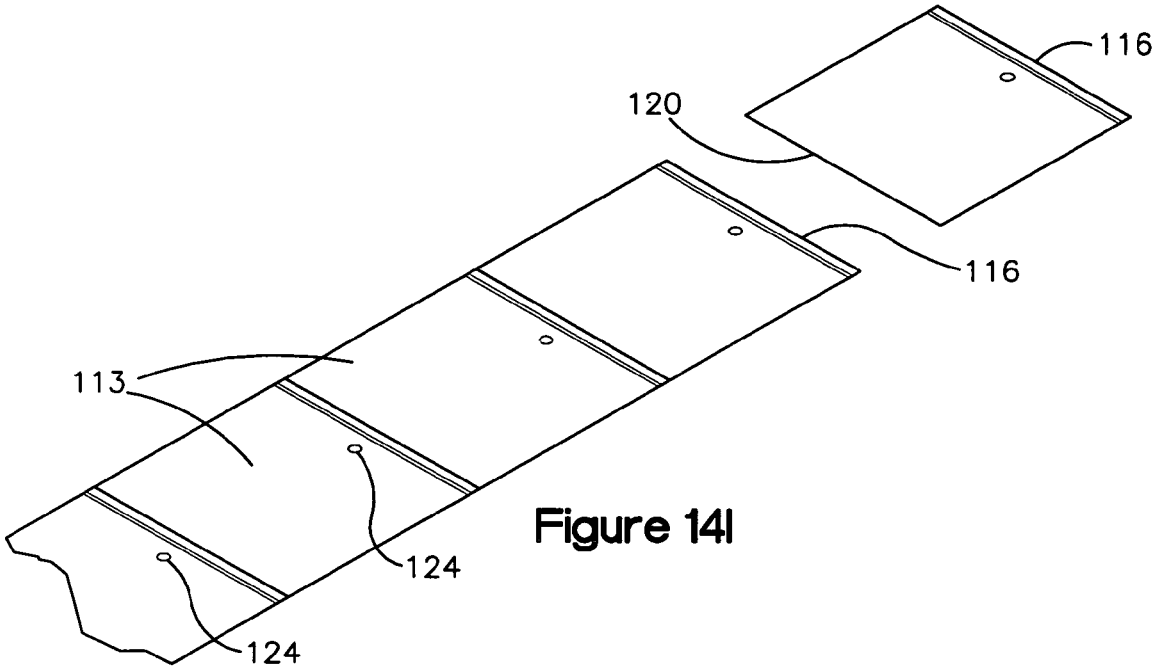
Figure 14J:
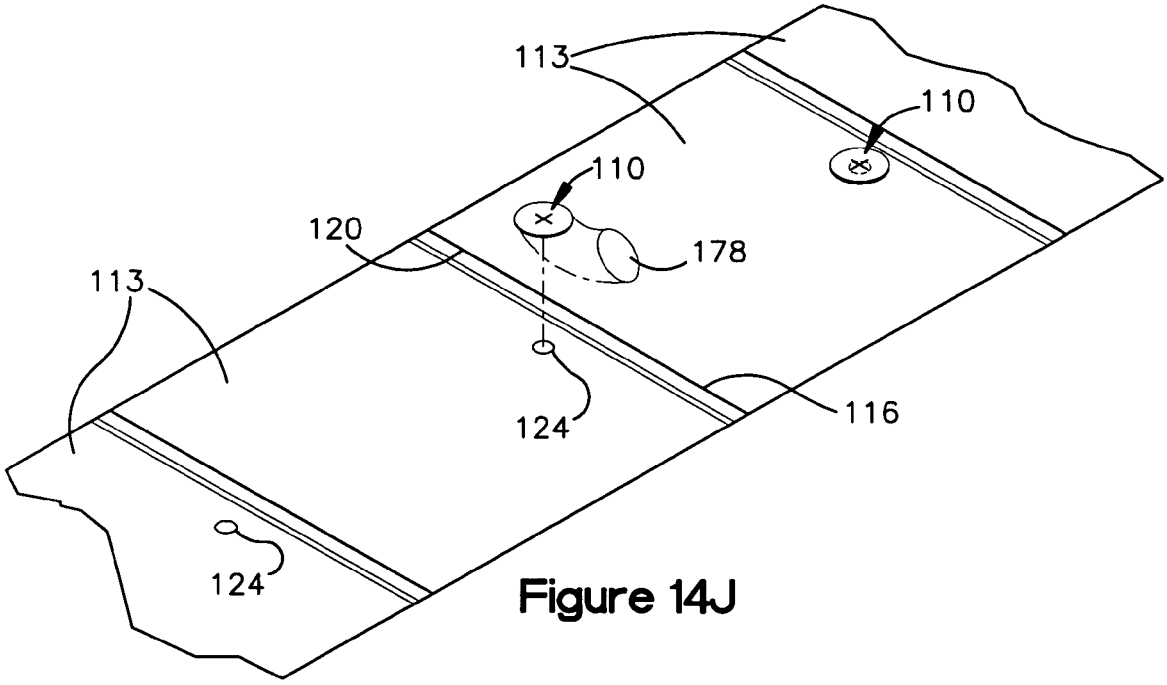
Figure 15:
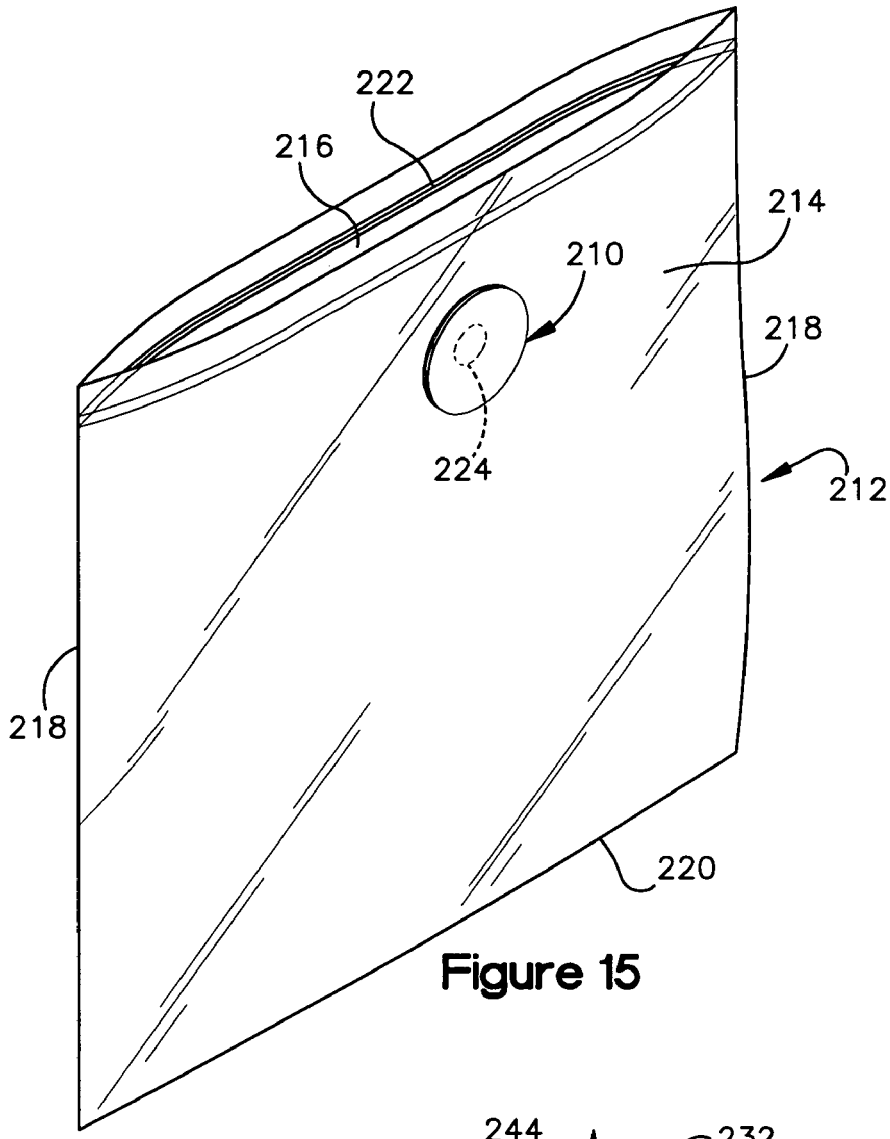
FIG. 15 is a front view of a food bag 212, which incorporates a valve 210 according to the present invention.

As shown in FIGS. 14A-14J, a plurality of the food bags 112 can be mass-manufactured in much the same manner as the food bags 12. With particular reference to the production of the web 180, the compilation of materials 160 and 170 is die cut into circles corresponding to the overall shape of the valves 110 and, preferably simultaneously, the cover material 160 is cut to form the slits 142. (FIGS. 14G and 14H.)

Referring now to FIGS. 15-24, another valve 210 and food bag 212 are shown. This valve 210, bag 212, and bag structure 213 are similar to the valve 10, the bag 12, and the bag structure 13 whereby like reference numerals (with "200" added thereto) are used to designate like parts. It is additionally noted that a plurality of the valves 210 and/or a plurality of the food bags 212 can be mass-manufactured in much the same way as the valves 10/110 and the food bags 12/212. (See FIGS. 17A-17J.)

Figure 16A:
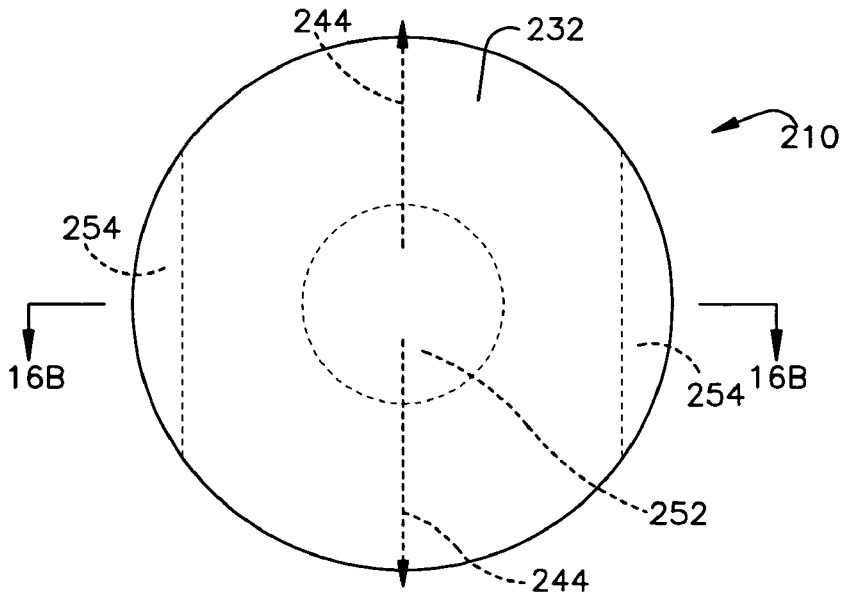
FIGS. 16A-16D are front and sectional views of the valve 210.
Figure 16B:
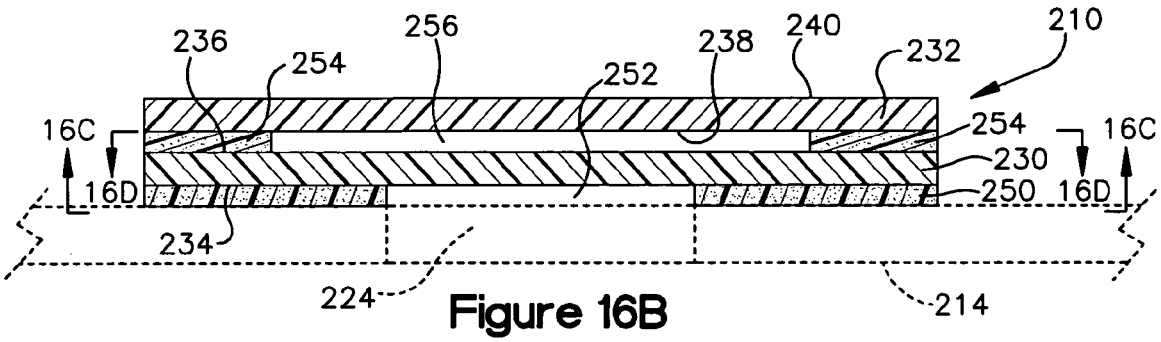
Figure 16C:
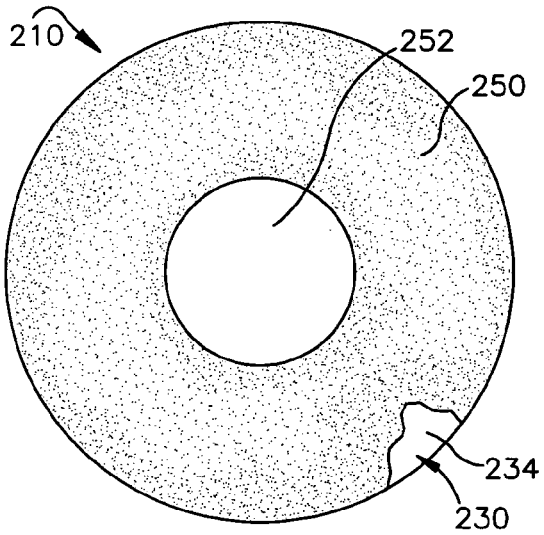
Figure 16D:
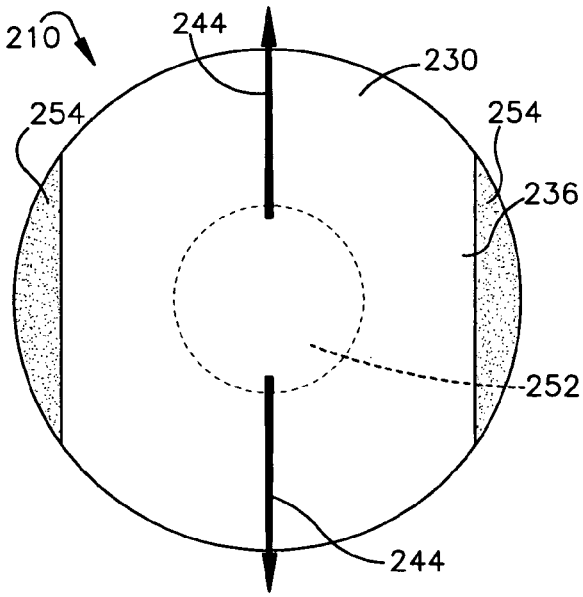
Figure 17A:
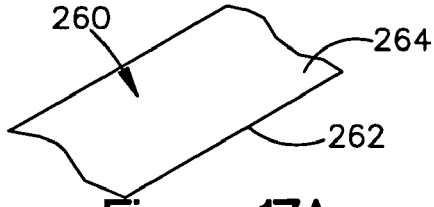
FIGS. 17A-17J are schematic views of method steps for making the valve 210.
Figure 17B:
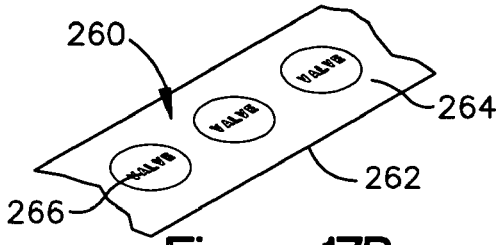
Figure 17C:
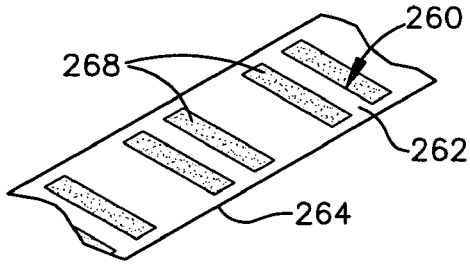
Figure 17D:
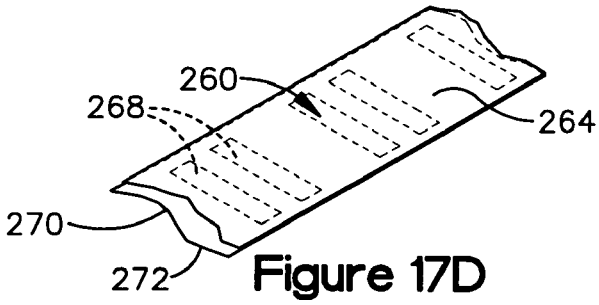
Figure 17E:
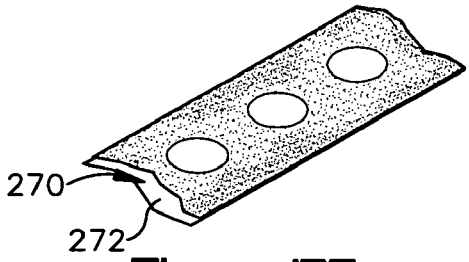
Figure 17F:
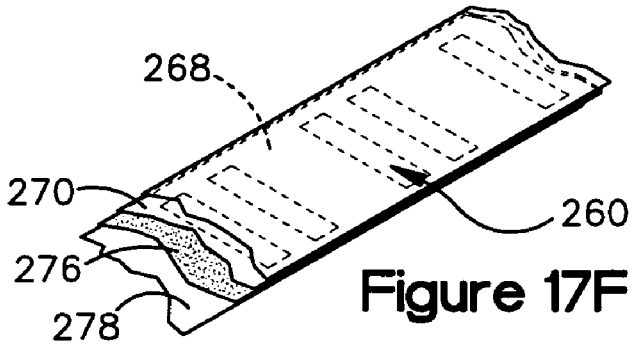
Figure 17G:
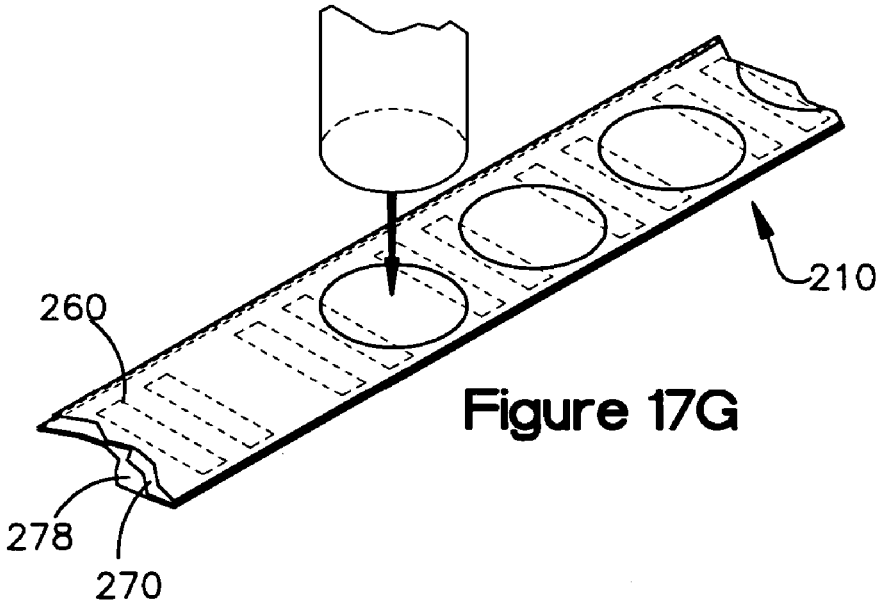
Figure 17H:
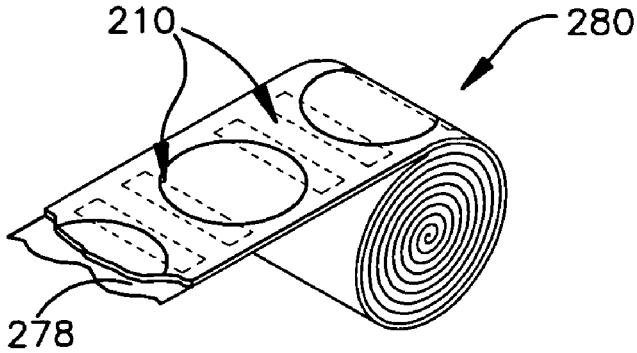
Figure 17I:
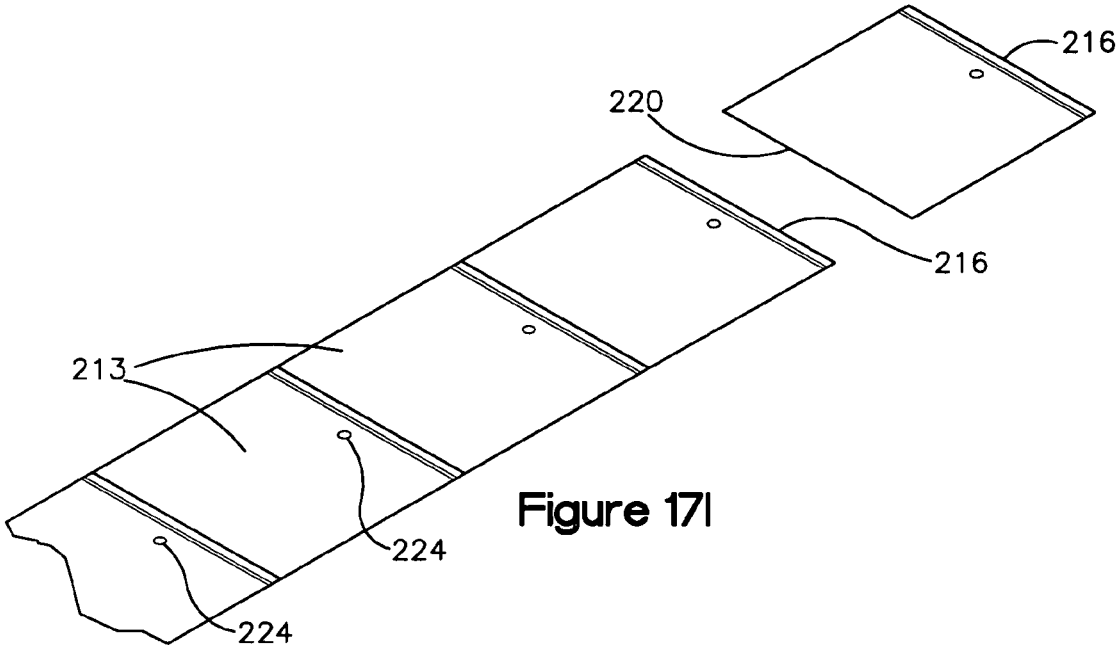
Figure 17J:
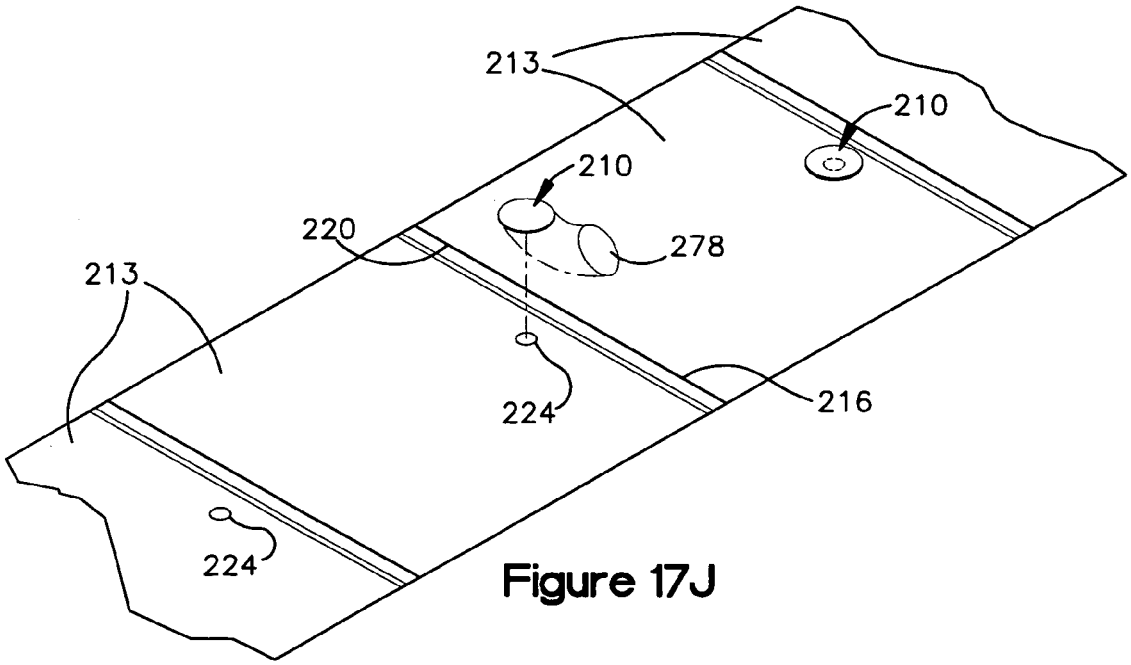

The valve 210 has a circular shape similar to the valve 110 and has a "baffle" flow path similar to (but not the same as) the valve 10. In the valve 210, the vent-to-cover adhesive area 254 comprises two bars occupying diametrically opposite arcs on the circular the surface 236, and the majority of the surface 236 is an adhesive-free area 256. (FIGS. 16B and 16D.) The adhesive-free area 256 extends to side edge portions of the valve 210, whereby the traverse baffling passageways 244 are formed for the escaping gas.

As for the bag-to-vent adhesive 250, it occupies a region aligned with the non-adhesive area 256 (e.g., the baffle area) between the vent layer 230 and the cover layer 232. Thus, if the adhesive 250 were to migrate through the vent layer 230 in this region, adhesive could find its way into non-adhesive area 256, causing the cover layer 232 to "stick to" the vent layer 230 in this area 256. This sticking could constrict, or close, the passageways 244 through which the released gas flows to exit the valve 210, thereby inhibiting the valve's proper operation.

The migration of the bag-to-vent adhesive 250 to the non-adhesive area 256 could occur at many times during the life of the valve 210. For example, this migration could start during production of the valves 210, as early as when the adhesive 276 is applied to the vent material 270. Alternatively, migration could first begin during storage or shipment of the valves 210, even if these valves came off the production line migration-free. The present invention provides features which minimizes migration of the adhesive 250 and/or prevents sticking of the cover layer 232 in the non-adhesive area 256 upon such migration.

According to the present invention, the adhesive 276 is chosen so that its glass transition temperature (Tg), softening point, and viscosity are as high as possible. These three properties are believed to be the key properties affecting flow, or migration, through nonwoven vent material. An example of suitable hot melt pressure sensitive adhesive is H2187-01 hot melt PSA, which is sold by Ato Findley, Inc., of Wauwatosa, Wis. When compared to conventional bag-to-vent adhesives, this adhesive has 8° C. higher glass transition temperature ($T_g$), 30° F. higher softening point, and 3000 cps higher viscosity at 325° F. reference temperature.

Figure 18:
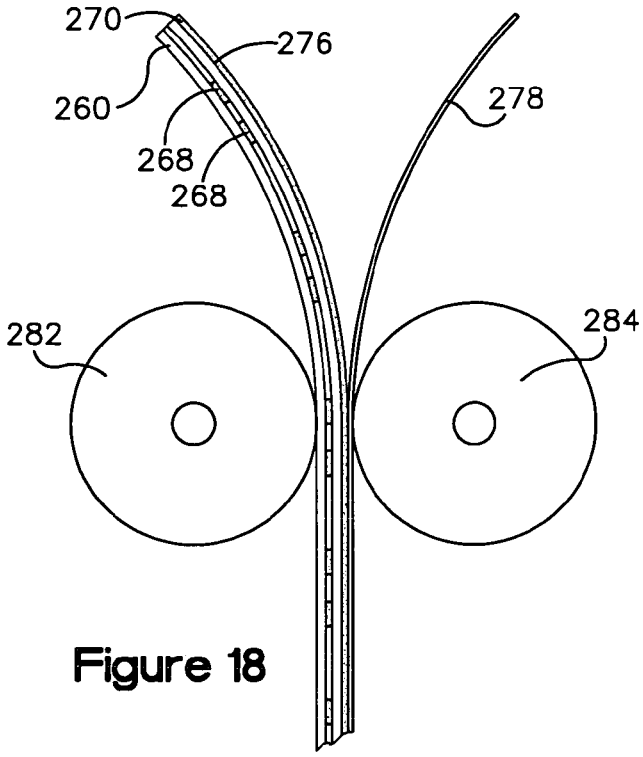
FIG. 18 is a schematic view of equipment when making the valve 210.

Also, measures can be taken to accelerate solidification of the adhesive 276 during production. For example, as shown in FIG. 18, a roller 282 and/or a roller 284 encountering the adhesive 276 just after application can be chilled (e.g., cooled by a cooling water) to reduce the temperature of the adhesive 276 just after application. Additionally or alternatively, the application temperature of the adhesive 276 can be minimized and/or the adhesive coat weight can be minimized.

Figure 19A:
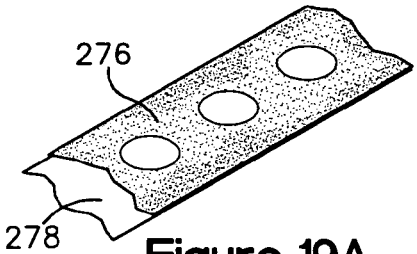
FIGS. 19A and 19B are schematic views of some modified step in the method for making the valve 210.
Figure 19B:
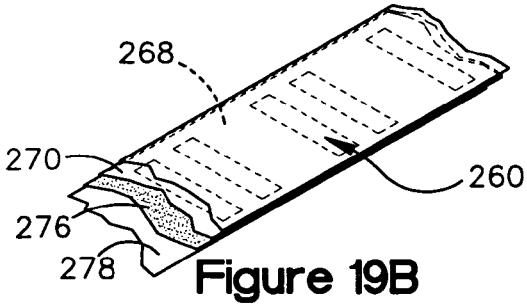

The application of the adhesive 276 can also be altered to accelerate solidification and/or otherwise minimize migration issues. For an example, as shown in FIGS. 19A and 19B, the adhesive 276 can be pattern applied to the release liner 278 and then transferred to the inner surface of the vent material 270. (Compare FIGS. 17E and 17F wherein the adhesive 276 is applied to the vent material 270 and then the release liner 278 is placed thereover.)

Figure 20A:
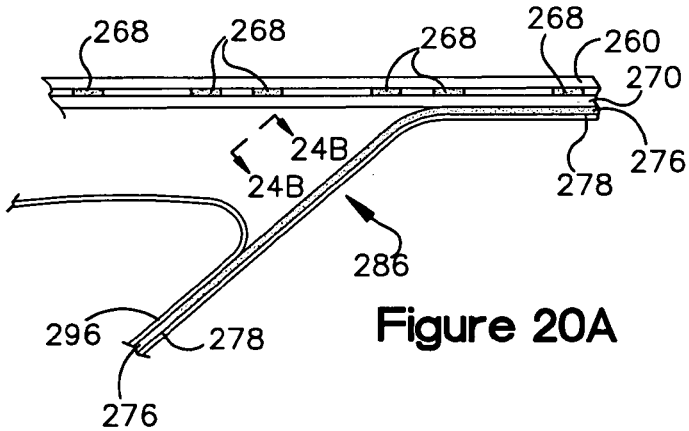
FIGS. 20A and 20B are schematic views of some other modified steps in the method of making the valve 210.
Figure 20B:
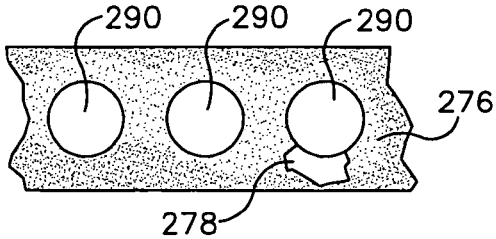

For another example, as shown in FIGS. 20A and 20B, the adhesive 276 could be provided as a cold film in a transfer tape 286 and laminated to the vent material 270. In the illustrated embodiment, the adhesive 276 is positioned between a liner 288 and the release liner 278, with the liner 288 being removed prior to lamination and the release liner 278 remaining with the adhesive 276 after lamination. The tape 286 (including the liners 288 and 278) is die-cut to provide circular openings 290 corresponding to the non-adhesive areas 252 on the valves 210. Thus, in the web 280 (FIG. 17H), the release liner 278 will include the openings 290 aligned with the non-adhesive areas 252 of the valves 210.

Referring now to FIGS. 21 and 22, the valve 210 is modified to include a barrier layer 292 to prevent migration of the bag-to-vent adhesive 252 into the area 256. The barrier layer 292 can be positioned on the inner surface 234 of the vent layer 230 (FIGS. 21A-21C) or the barrier layer 292 can be positioned on the outer surface 236 of the vent layer (FIGS. 22A-22C). The barrier layer 292 can occupy an area which mirrors the shape of the adhesive area 250 (FIGS. 21B and 22B) or it can cover only the area crucial to forming the baffle passageways 244 (FIGS. 21C and 21D).

The barrier layer 292 can comprise an adhesive coated film which is laminated to the vent material 270 at the appropriate production stage. In the illustrated embodiment, the coated film would have to be die cut to include the proper doughnut shape (or hole) prior to this application. The adhesive of the coated film would need to adhere appropriately to the vent material 270, and the film of the coated film would need to allow adherence of the adhesive 276 thereto.

The barrier layer 292 can comprise a flowable barrier material coated on the vent material 270 at the appropriate production stage. The barrier material can be a polymeric material. For example, the barrier layer can comprise a solvent based epoxy, an emulsion based urethane, an emulsion based acrylic, a curable (e.g., UV curable) acrylic or urethane, and/or a solvent based polyamide. A commercial example of a suitable barrier coating is Corkote IJ-1012' from Cork Industries, Jacksonville, Fla., which is an emulsion based acrylic coating.

The barrier material must, of course, have good adhesion, bonding, and/or connection with the vent material 70. To this end, the barrier material should be able to form a continuous/uniform solid layer (e.g., a lattice network) on the vent material 270. If the barrier material penetrates through pores in the vent material 270, solidification should occur within vent material (i.e., prior to exiting the pores).

Material compatibility must be taken into consideration when selecting a barrier material. For example, if the vent material 270 has been surface treated, a different solvent may have to be used to disperse the barrier material to generate coating of different quality/morphology. For example, the vent layer 230 in the illustrated embodiment can comprise a non-woven polymer treated with a fluoropolymer to make it hydrophobic and/or water repellent. The barrier material dispersed in water/polar solvent would be inclined to form layer on top of the non-woven vent material 270, with minimum penetration into its open (or pored) structure. On the other hand, barrier material dispersed in non-polar solvent, such as toluene/hexane, would tend to fill up the pores.

Equipment availability and/or process requirements might also influence the selection of an appropriate barrier material. For instance, if the barrier coating is applied by a flexo-printing station (or other device which is designed to render thin coatings), it might be quite difficult to have a continuous/uniform layer on top of vent material 270. In this case, it might be more realistic to choose a barrier coating that can be applied to penetrate the pores of vent material, followed by quick solidification.

The barrier material must also withstand production and post-production handling. Specifically, for example, the barrier layer 292 should not be easily damaged or rubbed off of the vent material 270 (or the vent layer 230). Once solidified, the barrier coating should behave like a thermoset material, so that there will be little deformation/budge over long periods of time and upon environmental changes, such as fluctuation of temperature.

Figure 21A:
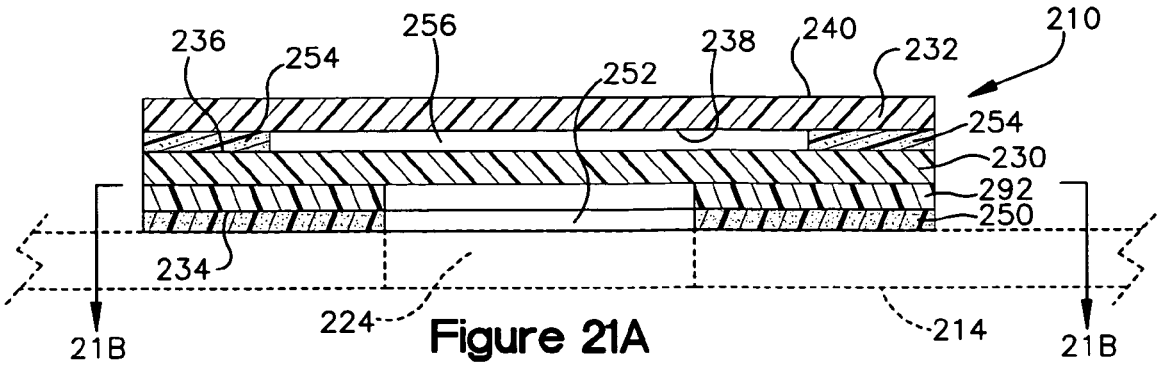
FIG. 21A is a sectional view similar to FIG. 16B, except that the valve 210 includes a barrier layer on the inner surface of its vent layer.
Figure 21B:
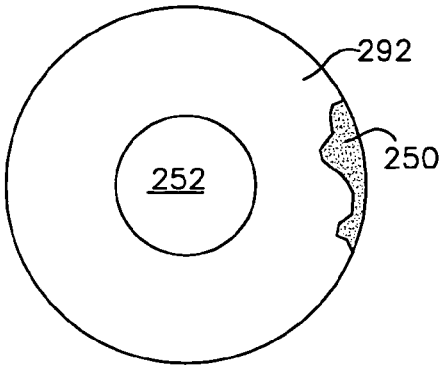
FIG. 21B is a view as seen along line 21B-21B in FIG. 21A.
Figure 22A:
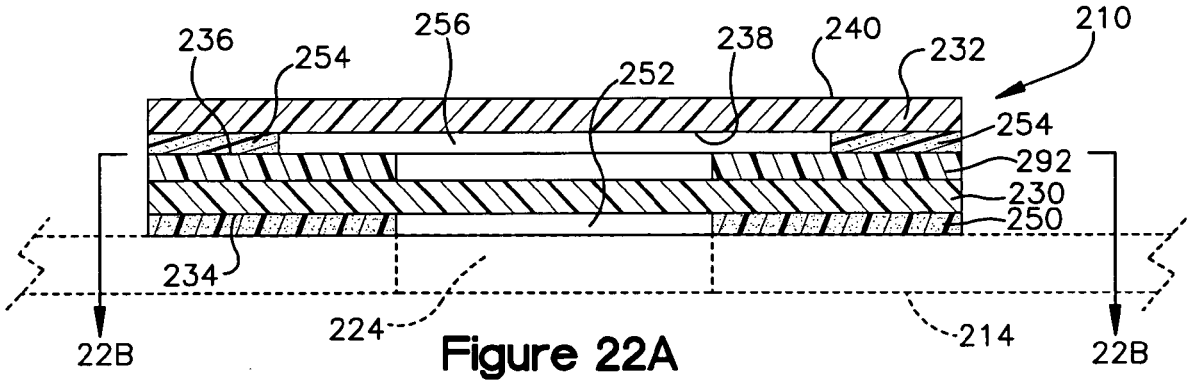
FIG. 22A is a sectional view similar to FIG. 16B, except that the valve 210 includes a barrier layer on the outer surface of its vent layer.
Figure 22B:
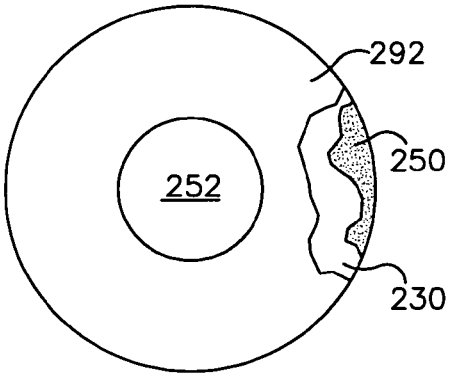
FIG. 22B is a view as seen along line 22B-22B in FIG. 22A.

In addition to the barrier material appropriately bonding to the vent material 270, in certain valve designs the barrier material must also accommodate bonding of the neighboring adhesive (specifically, adhesive 276 in FIGS. 21A and 21B, and adhesive 268 in FIGS. 22A and 22B). Moreover, the barrier material should preferably be selected so that it possesses minimum adhesion to the cover material 260 (e.g., BOPP film).

Figure 21C:
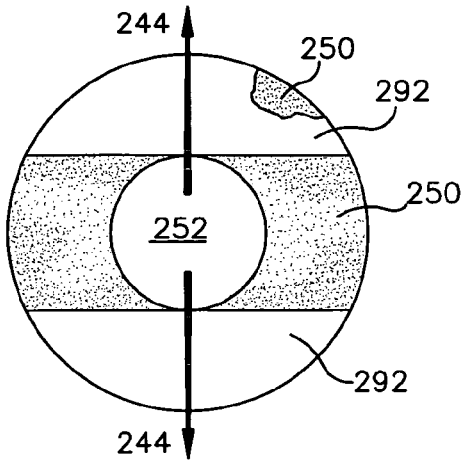
FIG. 21C is a view similar to FIG. 21B, showing a modified barrier layer.
Figure 21D:
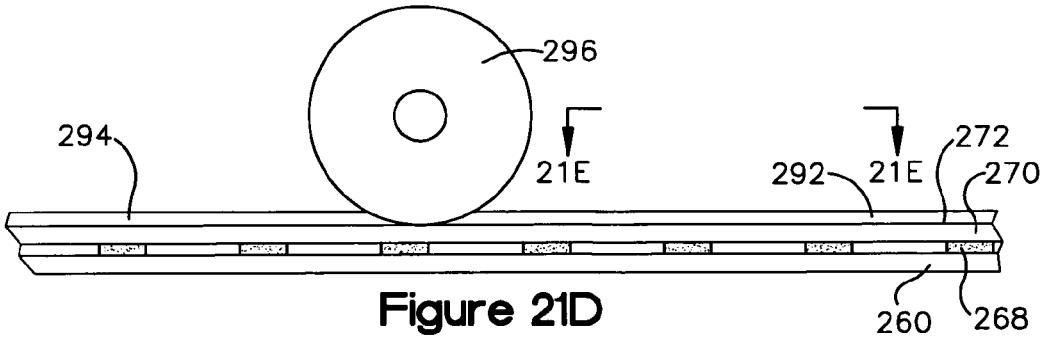
FIGS. 21D-21F are schematic views of steps for achieving the barrier layer shown in FIG. 21C.
Figure 21E:
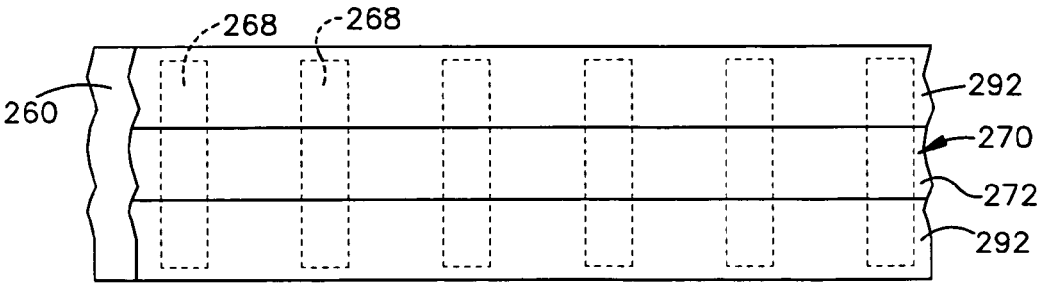
Figure 21F:
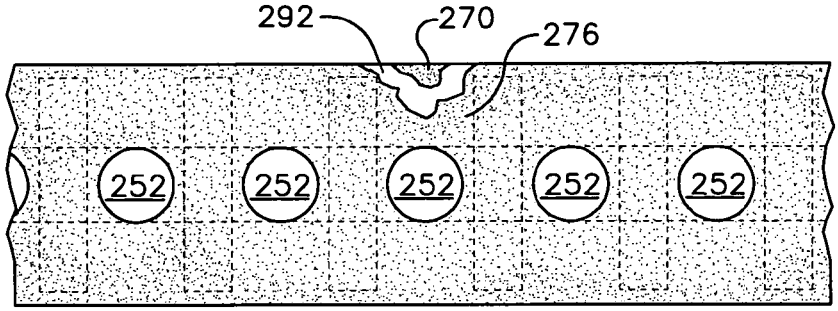
Figure 22C:
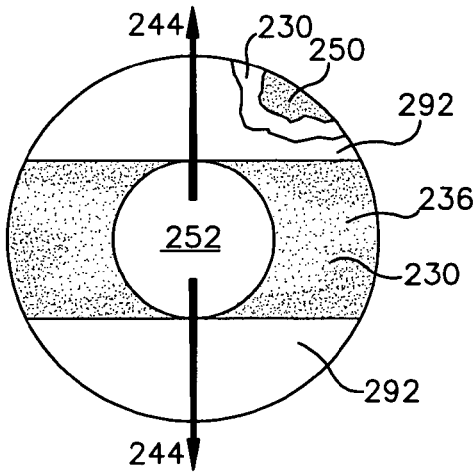
FIG. 22C is a view similar to FIG. 22B, showing a modified barrier layer.
Figure 22D:
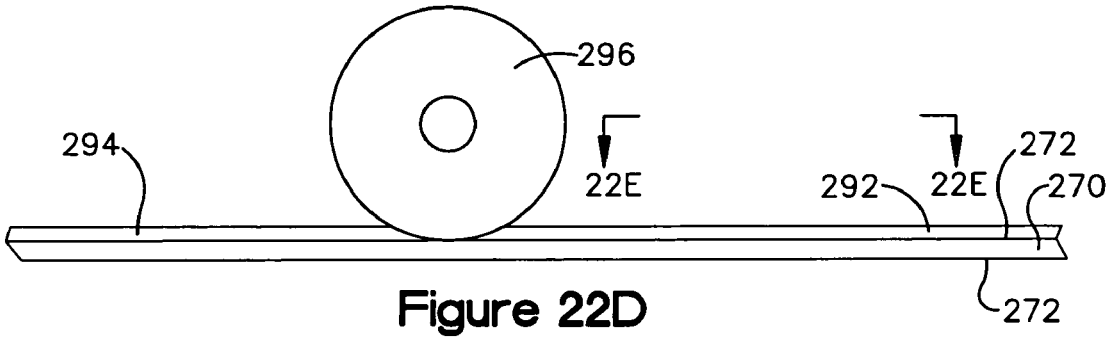
FIGS. 22D-22G are schematic views of steps for achieving the barrier layer shown in FIG. 22C.
Figure 22E:
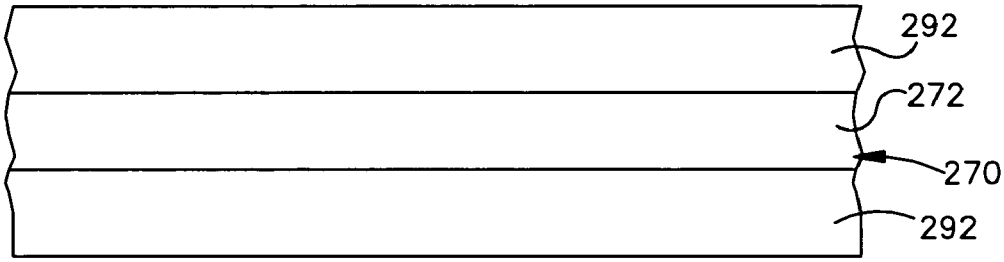
Figure 22F:
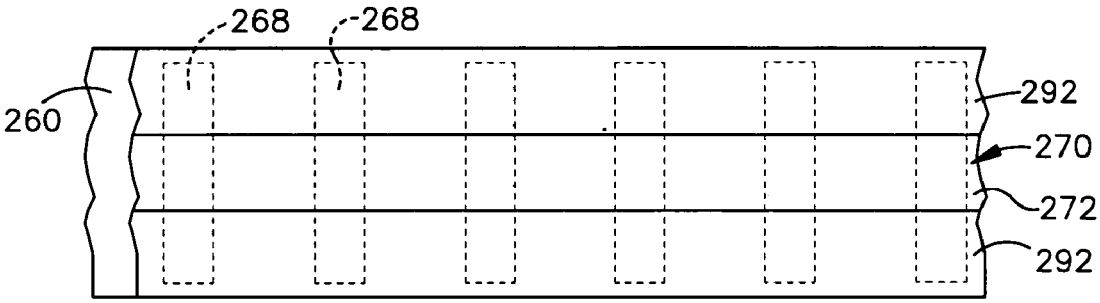
Figure 22G:
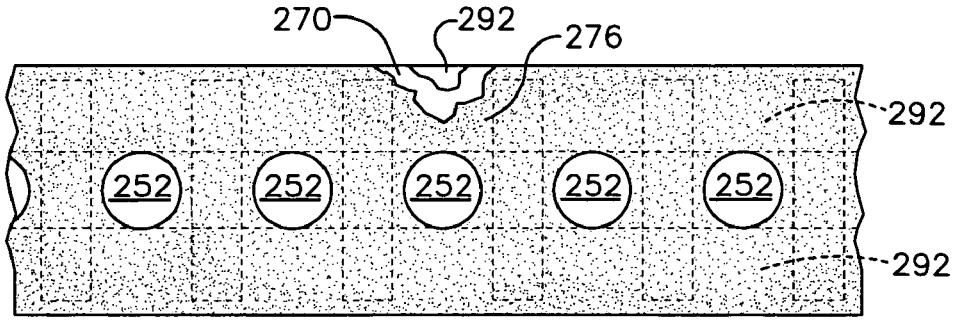

With particular reference to FIGS. 21C and 22C, the barrier layer 292 can be applied as a coating in stripes running in the longitudinal direction of the vent material 270 (and thus perpendicular to the adhesive bars 268 in the illustrated embodiment). For example, the barrier layer 292 can be formed from a heat sealable material 294, with the heat being applied by rollers 296 to form the stripes. The barrier material 294 can be provided in the form of a film or the barrier material 294 can be coated onto the vent material 270. The heat sealable material can comprise a polyethylene based, polyurethane based, polyester based, copolyester based, polyamide based, and/or amorphous polyolefin based polymer.

Figure 23A:
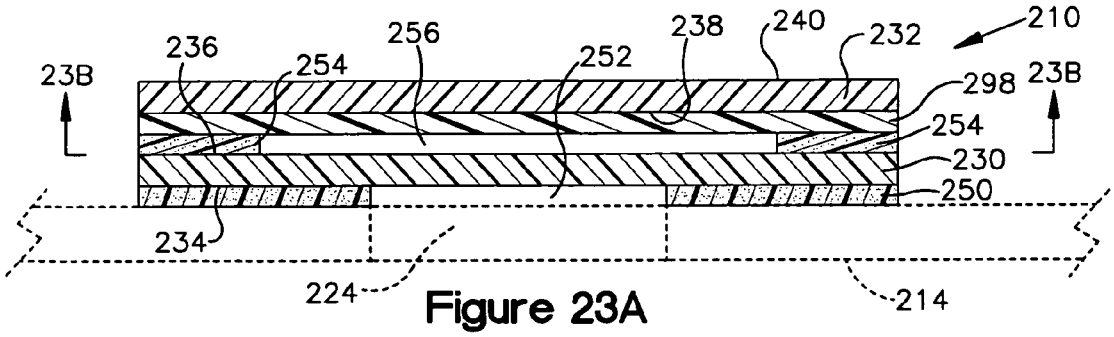
FIG. 23A is a sectional view similar to FIG. 16B, except that the valve 210 includes a release layer on the inner surface of its cover layer.
Figure 23B:
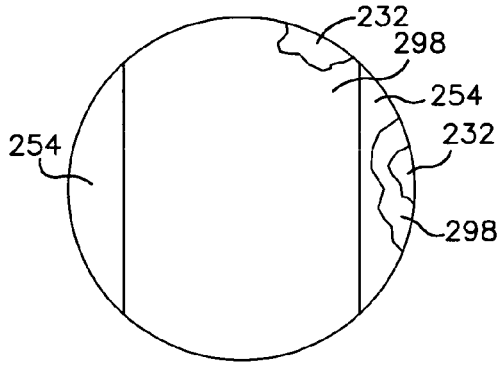
FIG. 23B is a view as seen along line 23B-23B in FIG. 23A.
Figure 23C:
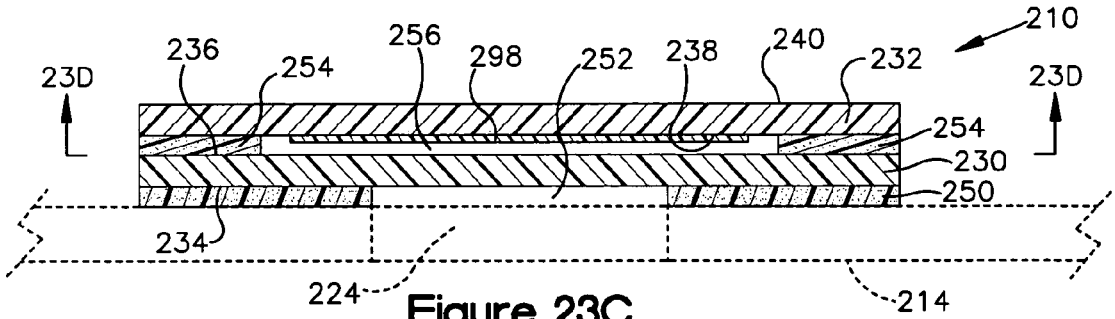
FIG. 23C is a view similar to FIG. 23B, with a modified release layer.
Figure 23D:
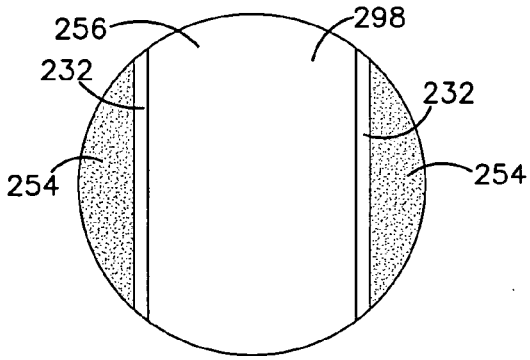
FIG. 23D is a view as seen along line 23D-23D in FIG. 23B.
Figure 24A:
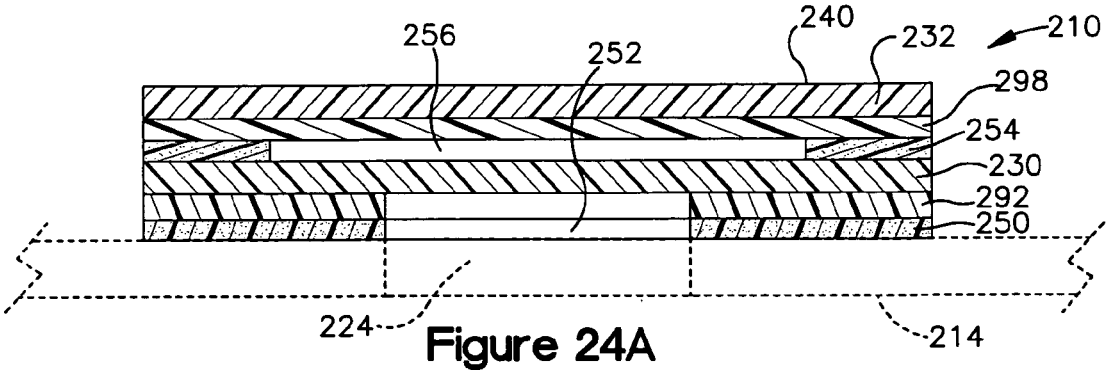
FIGS. 24A-24D are views similar to FIG. 16B, except that the valve 210 includes a barrier layer and a release layer.
Figure 24B:
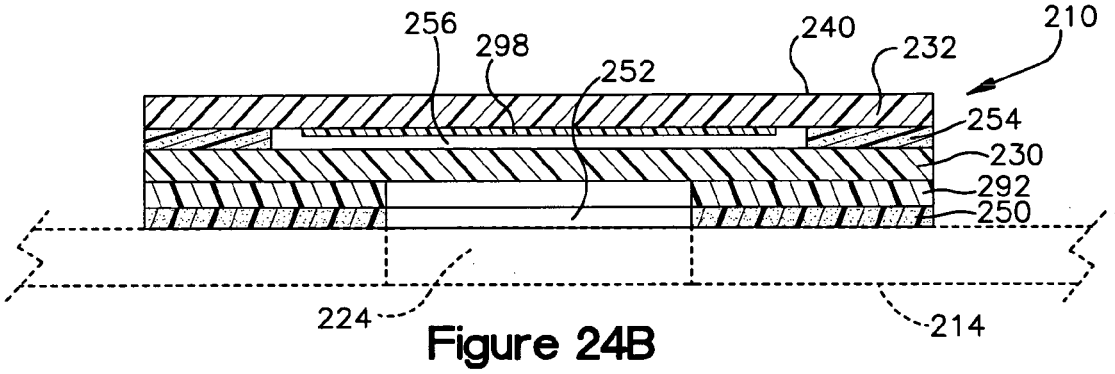
Figure 24C:
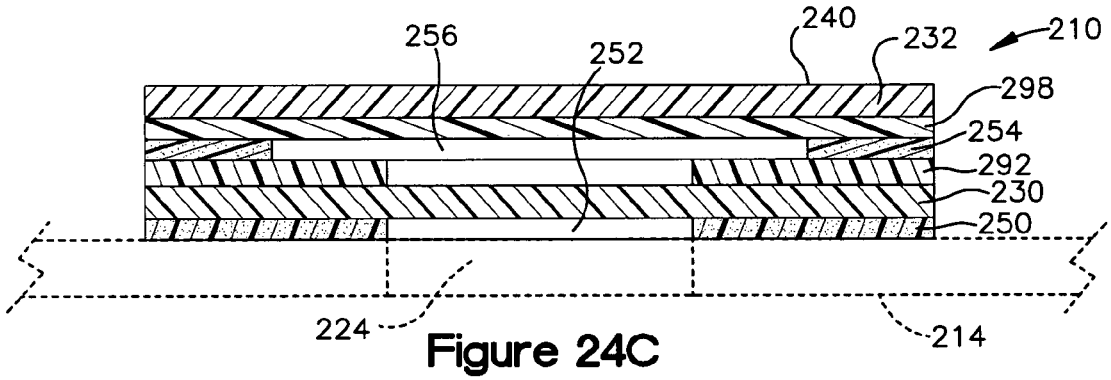
Figure 24D:
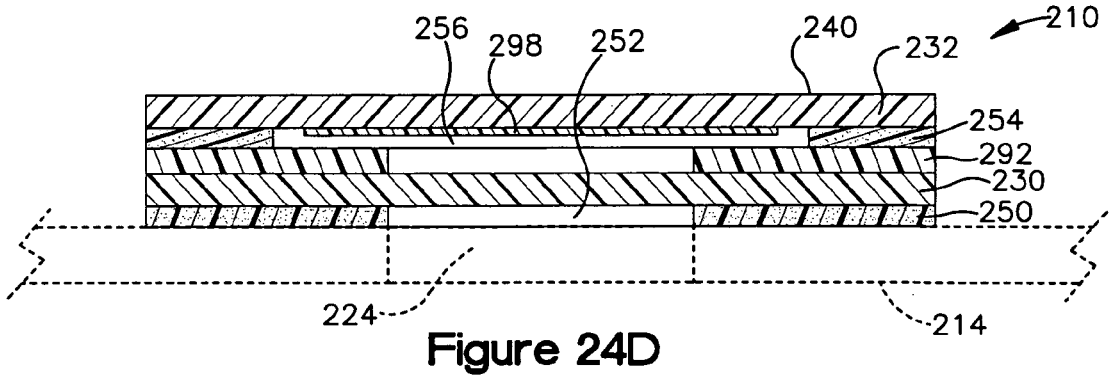

Referring now to FIGS. 23A-23D, the valve 210 is shown modified to include a release layer 298 on the inner surface 238 of the cover layer 232. The release layer 298 can cover the entire inner surface 238 of the cover layer 232 (FIGS. 23A and 23B) or can cover only a region aligned with the non-adhesive area 256 (FIGS. 23C and 23D). In either case, should the bag-to-vent adhesive 250 migrate through the vent layer 230, the release layer 298 would prevent the cover layer 232 from sticking to vent layer 230 via the migrated adhesive. The release layer 298 can comprise silicone coatings (UV cured or otherwise), wax-based coatings, polyethylene or other low surface energy spray or liquid coatings, flouridated coatings, or any other low surface energy coating to which a migrating adhesive would not adhere.

The different anti-stick means disclosed can be combined when appropriate and/or when necessary. For example, as shown in FIGS. 24A-24D, the valve 210 can include both a barrier layer 292 and a release layer 298. Also, for example, the release layer 298 can be used in conjunction with the adhesive 268 being transferred from the liner 278 and/or the adhesive 268 being provided by a transfer tape 286. One of the anti-stick means, or a combination of the anti-stick means, may be appropriate depending upon the intended application and other factors.

One now may appreciate that the present invention provides a valve 10/110/210 that provides sufficient (or even superior) freezer-burn protection and can be easily fabricated and incorporated into existing food bag designs. Unlike prior art attempts to address the problem of freezer burn, the present invention does not require any special bag constructions and/or closing means. In fact, almost any food bag construction can be modified to accommodate the valve of the present invention by simply forming the opening 24/124/224 in the appropriate place. Additionally or alternatively, the present invention provides a valve design which allows economic and efficient mass-manufacturing, which can maintain integrity during shipping to distant locations, and/or which can be easily integrated with bag structures during latter phases of production.

The valve 10/110/210 need not be used solely in food bags, but could find application in any flexible packaging container (for perishable and/or non-perishable items) wherein venting is necessary or desired. Additionally or alternatively, the venting action can be accomplished by the application of external pressure (e.g., a compressible portion of the package is pushed) or by increased internal pressure (e.g., increased temperatures or chemical reactions causing the pressure within the container to elevate).

Although the invention has been shown and described with respect to certain preferred embodiments, it is evident that equivalent and obvious alterations and modifications will occur to others skilled in the art upon the reading and understanding of this specification. The present invention includes all such alterations and modifications and is limited only by the scope of the following claims.

The invention claimed is:

1. A method of making a plurality of flexible containers, comprising the steps of:

manufacturing a plurality of bag structures, each bag structure having a panel with an opening therein;

separately manufacturing a plurality of valves, each valve comprising a vent layer which is pervious with respect to expected gasses and a sealable area;

aligning each of the valves with an opening in a bag structure so that the sealable area forms a sealed passageway between the vent layer and the bag structure; and securing the aligned valves to the bag structures;

wherein the valve manufacturing step comprises the steps of:

providing a vent material which is pervious with respect to expected gasses;

positioning an adhesive on an inner surface of the vent material in a pattern corresponding to the sealable areas;

cutting the vent material into shapes corresponding to the shape of the vent layer;

providing a cover material which is impervious with respect to the expected gasses;

positioning a vent-to-cover adhesive between the outer surface of the vent material and the inner surface of the cover material; and overlaying the vent material and the cover material so that the outer surface of the vent material is adjacent an inner surface of the cover material and secured thereto by the adhesive;

wherein the cover material is also cut during said cutting step and the valves also each include a cover layer and an area between the vent layer and the cover layer defined by the vent-to-cover adhesive.

2. A method as set forth in claim 1 wherein the bag-manufacturing step is performed at a bag-manufacturing location and the valve-manufacturing step is performed at a different valve-manufacturing location.

3. A method as set forth in claim 2, wherein the aligning step and/or the securing step are/is performed automatically by a machine.

4. A method as set forth in claim 1, wherein said valve-manufacturing step results in a web comprising a plurality of the valves.

5. A method as set forth in claim 4, wherein the web comprises a liner to which the plurality of valves are temporarily attached and wherein the method additionally comprises the step of removing the valves from the liner prior to the securing step.

6. A method as set forth in claim 5, wherein said removing step is performed automatically by a machine.

7. A method as set forth in claim 5, wherein the bag-to-vent adhesive also temporarily attaches the valves to the liner.

8. A method as set forth in claim 5, wherein the liner is in either roll form or sheet form.

9. A method of making a plurality of flexible containers as set forth in claim 1, wherein the area between the vent layer and the cover layer is a baffle area whereby the expected gasses will pass through the sealable area and through the vent layer into the baffle area and exit the baffle area after being turned substantially perpendicular by the cover layer.

10. A method of making a plurality of flexible containers as set forth in claim 1, wherein the area between the vent layer and the cover layer is a sealed area which forms a sealed passageway between the vent layer and the cover layer, and wherein the method further comprises the step of cutting slits in the cover material whereby each valve will include at least one slit in its cover layer whereby gasses can pass from the sealable area, through the vent layer to the sealed area, and exit the sealed area through the at least one slit.

11. A method of making a plurality of flexible containers, comprising the steps of:

manufacturing a plurality of bag structures, each bag structure having a panel with an opening therein;

separately manufacturing a plurality of valves, each valve comprising a vent layer which is pervious with respect to expected gasses and a sealable area;

aligning each of the valves with an opening in a bag structure so that the sealable area forms a sealed passageway between the vent layer and the bag structure; and securing the aligned valves to the bag structures;

wherein the valve manufacturing step comprises providing a vent material which is pervious with respect to expected gasses, positioning an adhesive on an inner surface of the vent material in a pattern corresponding to the sealable areas, and cutting the vent material into shapes corresponding to the shape of the vent layer;

wherein the valve manufacturing step includes the step of providing a web comprising a plurality of valves temporarily attached to a liner for selective removal therefrom for integration into a bag structure;

wherein each of the valves comprises:

a vent layer pervious with respect to expected gasses a bag-to-vent adhesive on an inner surface of the vent layer for permanently attaching each valve to the bag structure upon integration, a cover layer overlaying the vent layer and defining an area between the vent layer and the cover layer through which the expected gasses pass to exit the valve; wherein the area between the vent layer and the cover layer is a sealed area and wherein each of the valves includes at least one slit through the cover layer forming an exit from the sealed area, whereby released gasses can pass from the area, through the vent layer to the sealed area, and exit the sealed area through the at least one slit.

12. A method of making a plurality of flexible containers, comprising the steps of:

manufacturing a plurality of bag structures, each bag structure having a panel with an opening therein;

separately manufacturing a plurality of valves, each valve comprising a vent layer which is pervious with respect to expected gasses and a sealable area;

aligning each of the valves with an opening in a bag structure so that the sealable area forms a sealed passageway between the vent layer and the bag structure; and securing the aligned valves to the bag structures;

wherein the valve manufacturing step comprises providing a vent material which is pervious with respect to expected gasses, positioning an adhesive on an inner surface of the vent material in a pattern corresponding to the sealable areas, and cutting the vent material into shapes corresponding to the shape of the vent layer;

wherein the valve manufacturing step includes the step of providing a web comprising a plurality of valves temporarily attached to a liner for selective removal therefrom for integration into a bag structure;

wherein each of the valves comprises:

a vent layer pervious with respect to expected gasses a bag-to-vent adhesive on an inner surface of the vent layer for permanently attaching each valve to the bag structure upon integration, a cover layer overlaying the vent layer and defining an area between the vent layer and the cover layer through which the expected gasses pass to exit the valve; wherein the area between the vent layer and the cover layer is a baffle area whereby released gasses can pass through the vent layer to the baffle area and exit the baffle area after being turned substantially perpendicular by the cover layer.

13. A method as set forth in claim 12, wherein each of the valves includes anti-stick means for preventing the bag-to-vent adhesive area from causing the cover layer to stick to the vent layer in the baffle area and thereby block the passageway(s).

14. A method as set forth in claim 13, wherein the anti-stick means comprises barrier means for preventing migration of the adhesive area through the vent layer.

15. A method as set forth in claim 13, wherein the anti-stick means comprises release means for releasing the cover layer from the vent layer should the bag-to-vent adhesive migrate through vent layer into the area.

* * * * *